US006672978B1

(12) United States Patent
Morgan et al.

(10) Patent No.: US 6,672,978 B1
(45) **Date of Patent: *Jan. 6, 2004**

(54) GOLF BALL FITTING SYSTEM WITH INTERACTIVE FEEDBACK AND MODIFICATION METHOD

(75) Inventors: William E. Morgan, Barrington, RI (US); Mary Lou Bohn, Dover, MA (US); Edmund A. Hebert, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 157 days.

This patent is subject to a terminal disclaimer.

(21) Appl. No.: 09/613,721

(22) Filed: Jul. 11, 2000

Related U.S. Application Data

(63) Continuation-in-part of application No. 09/283,967, filed on Apr. 2, 1999, now Pat. No. 6,086,487.

(51) Int. Cl.[7] ..... A63B 57/00

(52) U.S. Cl. ..... 473/407; 473/131; 473/278; 473/409

(58) Field of Search ..... 473/407, 409, 473/289, 351, 131, 278, 292, 385, 384

(56) References Cited

U.S. PATENT DOCUMENTS

| | | | | |
|---|---|---|---|---|
| 4,063,259 A | | 12/1977 | Lynch et al. | 354/120 |
| 4,375,887 A | | 3/1983 | Lynch et al. | 273/32 H |
| 5,094,101 A | * | 3/1992 | Chastonay | 73/65.03 |
| 5,713,803 A | | 2/1998 | Oshima | 473/407 |
| 5,864,960 A | | 2/1999 | DeNicolo et al. | 33/508 |
| 6,086,487 A | * | 7/2000 | Morgan et al. | 473/131 |
| 6,192,323 B1 | * | 2/2001 | Boehm | 264/219 |

FOREIGN PATENT DOCUMENTS

WO WO 00/21014 4/2000

OTHER PUBLICATIONS

Business Wire, Golf Bll Analyzer Display, May 30, 1997, 2 pages.*
Choose the Right Ball for your Game, Golf Digest, May 1958, pp. 27–29.
The Amazing Golf Ball, AMF Ben Hogan Company, 1978, pp. 1–17.
Is This the Ultimate Swing Analyzer?, Jerry Tarde, Golf Digest, Oct. 1980, (reprint) 8 pages.
Golfing's Ballfitting Guide, Mike Corcoran, Golfing Magazine, Apr. 1995, pp. 52–54.
The Golf Ball, Titleist and Foot–Joy Worldwide, 1996, pp. 1–22.
Page regarding Maxfli Golf Balls from http://maxfli.com printed on Feb. 12, 1999, 1 page.
Page regarding Titleist Golf Balls from http://www.titleist-.com printed on Feb. 12, 1999, 1 page.

* cited by examiner

*Primary Examiner*—Derris H. Banks
*Assistant Examiner*—Alex F. R. P. Rada, II
(74) *Attorney, Agent, or Firm*—Swindler Berlin Shereff Friedman, LLP

(57) ABSTRACT

A method for interactively determining an optimal golf ball for a golfer comprising the steps of determining the golfer's current golf ball and whether the golf ball meets the golfer's critical playing characteristics; iteratively prioritizing the golfer's golf ball performance characteristics to form prioritized critical playing characteristics; and selecting a second golf ball from a set of golf balls that best matches the golfer's prioritized critical playing characteristics.

26 Claims, 18 Drawing Sheets

F. DT SPIN

G. HP ECLIPSE

GOLF BALL FITTING SYSTEM WITH INTERACTIVE FEEDBACK AND MODIFICATION METHOD

This application is a continuation-in-part of U.S. patent application Ser. No. 09/283,967, filed Apr. 2, 1999, now U.S. Pat. No. 6,086,487.

FIELD OF THE INVENTION

The present invention generally relates to interactive methods for fitting a golfer with golfing equipment. More specifically, the present invention relates to an interactive, iterative method of matching a golfer with a particular golf ball, designed to achieve ultimate scoring performance.

BACKGROUND OF THE INVENTION

Methods of custom fitting a golfer to the most suitable golf ball, taking into account the golfer's individual swing characteristics, are well known within the golf industry. For example, the testing laboratory at the Acushnet Golf Center in New Bedford, Mass., has been measuring and analyzing the swing characteristics and ball launch conditions of thousands of golfers since the early seventies, as described in a special editorial report in the October 1980 issue of Golf Digest. As a result of this and more recent testing, Acushnet has developed an accurate method of matching a golfer with particularized golfing equipment, including golf balls. This method utilizes sophisticated equipment that measures golf ball launch conditions while the golfer hits golf balls of different construction and performance characteristics with a variety of drivers having variations in head and shaft characteristics. A camera monitors the golfer's swing by tracking the movement of a cluster of reflective dots of the golf ball. The camera has strobe lights that emit light immediately at two different times immediately after the club hits the ball. The light reflects off the reflective dots and is captured by the camera and sent to a computer for processing. This data is then recorded and analyzed using complex mathematical models which are able to calculate, among other things, the distance that a golf ball travels when struck off the tee by the golfer with a driver. From this information, the most appropriate golf ball can be determined for that specific golfer's swing. Although this methodology accurately matches a golfer to a golf ball, it requires the use of expensive electronic measuring equipment not always readily available.

Spalding® has developed the System C and System T golf balls which are designed specifically for use with the Callaway® Great Big Bertha driver (System C) and the Taylor Made® Ti Bubble 2 driver (System T). However, the Spalding® system fails to consider key variables such as the golfer's swing speed, club loft angles, and shaft flex. Additionally, the club/ball matching system is really only intended to aid in maximizing golf ball distance, not to aid in selecting a golf ball that will help a golfer score better based on their critical playing characteristics. The Spalding® system selects one ball for all golfers to play, regardless of their ability. Similarly, Dunlop® has proposed a method which matches a player's swing speed to a particular ball compression. However, this method fails to consider the golfer's playing ability, their critical playing characteristics, design of the club head, and the type and flex of the shaft.

An article in the May, 1958 issue of Golf Digest, entitled "Choose the right ball for your game", presents a ball-fitting method based solely on golf ball compression. It is suggested simply, that a 'good player' play high compression golf balls, an 'average player' play medium compression golf balls, and 'high scorers' play low compression golf balls. This system of matching compression to ability is directed to enhancing ball distance. A definition of what defines the caliber of player, such as swing speed, distance, or handicap, is not discussed. Additionally, the type of game the golfer plays and the critical golf ball playing characteristics of the golfer, such as spin, feel, and durability, are not considered.

A 1978 publication by the AMF Ben Hogan Company, entitled "The Amazing Golf Ball", presents a discussion of the history and evolution of the golf ball and the characteristics that potentially influence a golfer's game, such as dimples (aerodynamic forces of lift and drag), types of covers (balata versus durable), types of centers (solid versus liquid), manufacturing methods and influence of golf balls (causing out of balance, out of round, and weight distribution problems), elasticity, and compression. Golfers are encouraged to simply choose between a balata or durable cover, followed by a selection of compression—no advice is given on making these selections and the golfer's type of game, skill level, handicap, distance, etc. . . are not considered.

An April, 1995 article in Golfing Magazine, entitled "Golfing's Ball-fitting Guide", presents a cursory overview of some factors to consider when selecting a golf ball. These include the golfer knowing the strengths and weaknesses of their game and, with this in mind, considering three-piece or two-piece construction, dimple shape (shallow versus deep), type of golf club shaft, golf ball price, and comfort level. Types and groups of golf balls are not presented and narrowed to a particular ball, and the ability of the player and their ball preferences are not considered.

U.S. Pat. Nos. 4,063,259 and 4,375,887 disclose a method for matching a golfer with golf balls having varying aerodynamic properties. The launch conditions of the golf ball are measured to determine the golf ball dimple pattern most suitable for a particular golfer.

U.S. Pat. No. 5,713,803 discloses a golf ball-containing package having a section defined for indicating the performance of a golf ball. Sub-sections of the chart are selectively marked to indicate the golf ball structure, recommended head speed, feel, spin, green targeting, and trajectory.

Other simple golf ball fitting methods have been developed for use on a web site. Titleist®, for example, asks the golfer to answer a few simple questions about their golf game and preferred golf ball characteristics. Maxfli® has come up with a similar questionnaire that asks golfers using their web site to answer a few questions about golf ball preferences and the distance they typically hit the ball.

International Publication No. WO 00/21014 discloses a computerized method for soliciting orders for customized game balls by one or more users from remote sites.

A common feature of the above golf ball fitting methods is their focus on increasing distance. This result alone is relied upon to help improve a golfer's game. None of the above methods, however, adequately meets the demand for a simple, yet accurate, golf ball fitting method, that takes into account a golfer's playing ability, type of shot that could most be helped by a correctly-fit golf ball, or the golfer's critical playing characteristics. The current invention is directed to helping golfers score better and in the most efficient manner, by matching the golfer's ability with their preferred golf ball performance characteristics and their critical playing characteristics and to provide feedback to the manufacturer through an iterative process with the golfer.

SUMMARY OF THE INVENTION

The present invention is directed to a method for interactively determining an optimal golf ball for a golfer comprising the steps of determining the golfer's current golf ball and whether the golf ball meets the golfer's critical playing characteristics; iteratively prioritizing the golfer's golf ball performance characteristics to form prioritized critical playing characteristics; and selecting a second golf ball from a set of golf balls that best matches the golfer's prioritized critical playing characteristics.

In one embodiment, the method further provides a feedback loop for further optimizing the golf ball. In another embodiment, the step of determining if the golf ball meets the golfer's critical playing characteristics comprises a plurality of questions. It is preferred that the step of prioritizing the ball performance characteristics comprises an interactive process of evaluating opposing ball characteristics. Opposing ball characteristics preferably include at least one of distance, spin, partial wedge spin, short iron spin, driver distance, durability, and feel.

In a preferred embodiment, the step of evaluating the opposing ball performance characteristics includes comparing at least one of a first group of characteristics comprising distance, durability, and driver distance versus at least one of a second group of characteristics comprising spin, feel, short iron spin, and partial wedge spin, to determine the ball performance relationships.

In one embodiment, a ball performance relationship is selected by the golfer expressing a preference of golf ball distance versus golf ball spin. In another embodiment, a golf ball performance relationship is selected by the golfer expressing a preference of golf ball durability versus golf ball spin. In still another embodiment, a golf ball performance relationship is selected by the golfer expressing a preference of golf ball feel versus golf ball distance. Alternatively, a golf ball performance relationship is selected by the golfer expressing a preference of golf ball driver distance versus golf ball spin. In yet another embodiment, a golf ball performance relationship is selected by the golfer expressing a preference of golf ball distance versus golf ball short iron spin. a golf ball performance relationship is selected by the golfer expressing a preference of golf ball distance versus golf ball partial wedge spin.

Preferably, the steps of determining the golfer's current golf ball and whether the golf ball meets the golfer's critical playing characteristic and prioritizing ball performance characteristics is performed by an online interaction with a manufacturer. In another embodiment, the steps of determining the golfer's current golf ball and whether the golf ball meets the golfer's critical playing characteristic and prioritizing ball performance characteristics is performed by a world wide web site. In still another embodiment, the steps of determining the golfer's current golf ball and whether the golf ball meets the golfer's critical playing characteristic and prioritizing ball performance characteristics is performed by using a computer program stored on one or more of a plurality of data storage devices. Alternatively, golfer's recommended golf ball is compared to a previously played golf ball through interactive responses to a plurality of questions.

The present invention is also directed to a method for selecting a golf ball from a predetermined set of golf balls comprising the steps of determining a golfer's critical playing characteristics; prioritizing ball performance characteristics; and selecting a golf ball from the set of golf balls which best matches the golfer's critical playing characteristics for the purpose of reducing the golfer's score; wherein the steps are performed on a portable storage device.

DESCRIPTION OF THE PREFERRED EMBODIMENTS

The current invention is directed to a method for selecting a golf ball from a predetermined set of golf balls, comprising the steps of determining a golfer's critical playing characteristics from the following: drive distance, approach shot accuracy, and short game ability, prioritizing the golf ball performance characteristics by comparing at least one of spin and feel versus at least one of durability and distance, and selecting a golf ball from the set of golf balls to best fit the golfer's critical playing characteristics and golf ball performance characteristics for the purpose of reducing the golfer's score.

In a preferred embodiment, a compact disc (CD-ROM) is created or a world wide web (www) site is set up to present a golfer with a series of questions about their golf game that aids in identifying said golfer's style of play and golf ball performance needs. The series of questions determining the golfer's critical playing characteristics and ball performance characteristics may also be in printed form such as a brochure.

Figure 1:
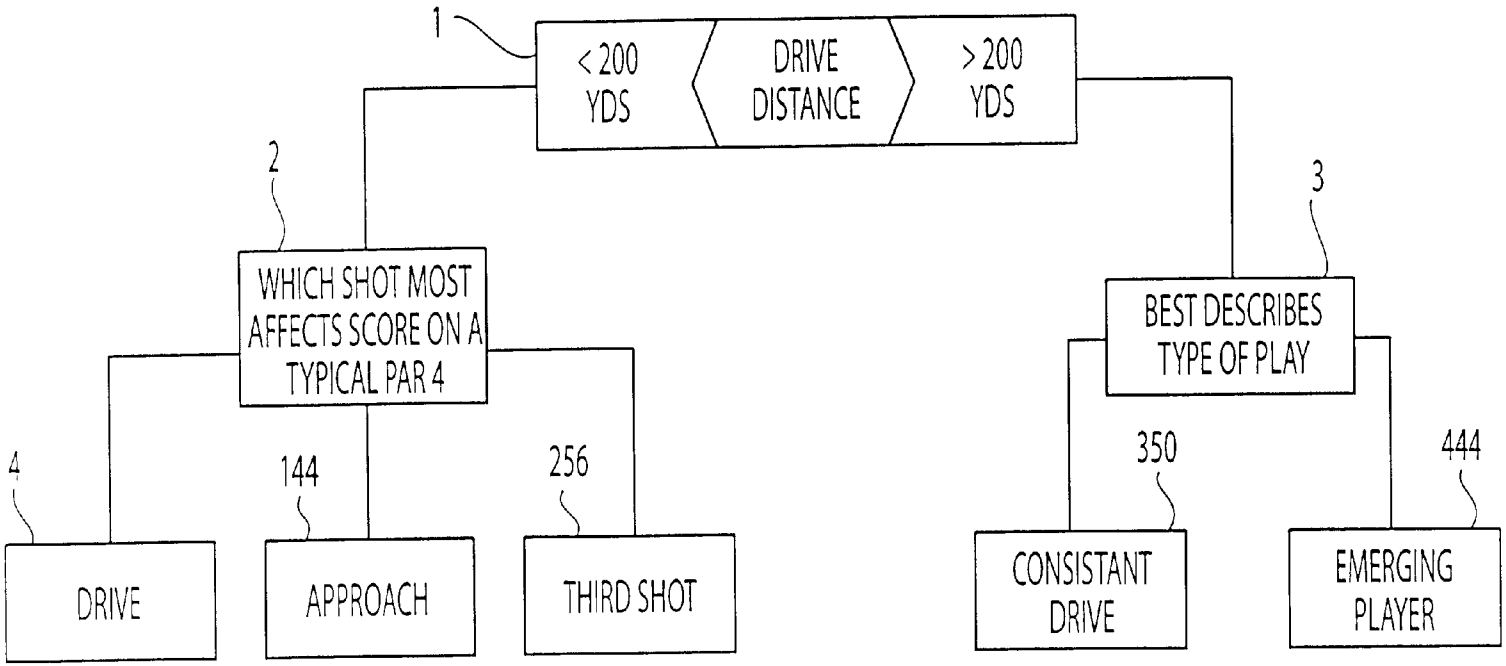
FIG. 1 is a decision tree having five categories of potential golfer responses.
Figure 2A:
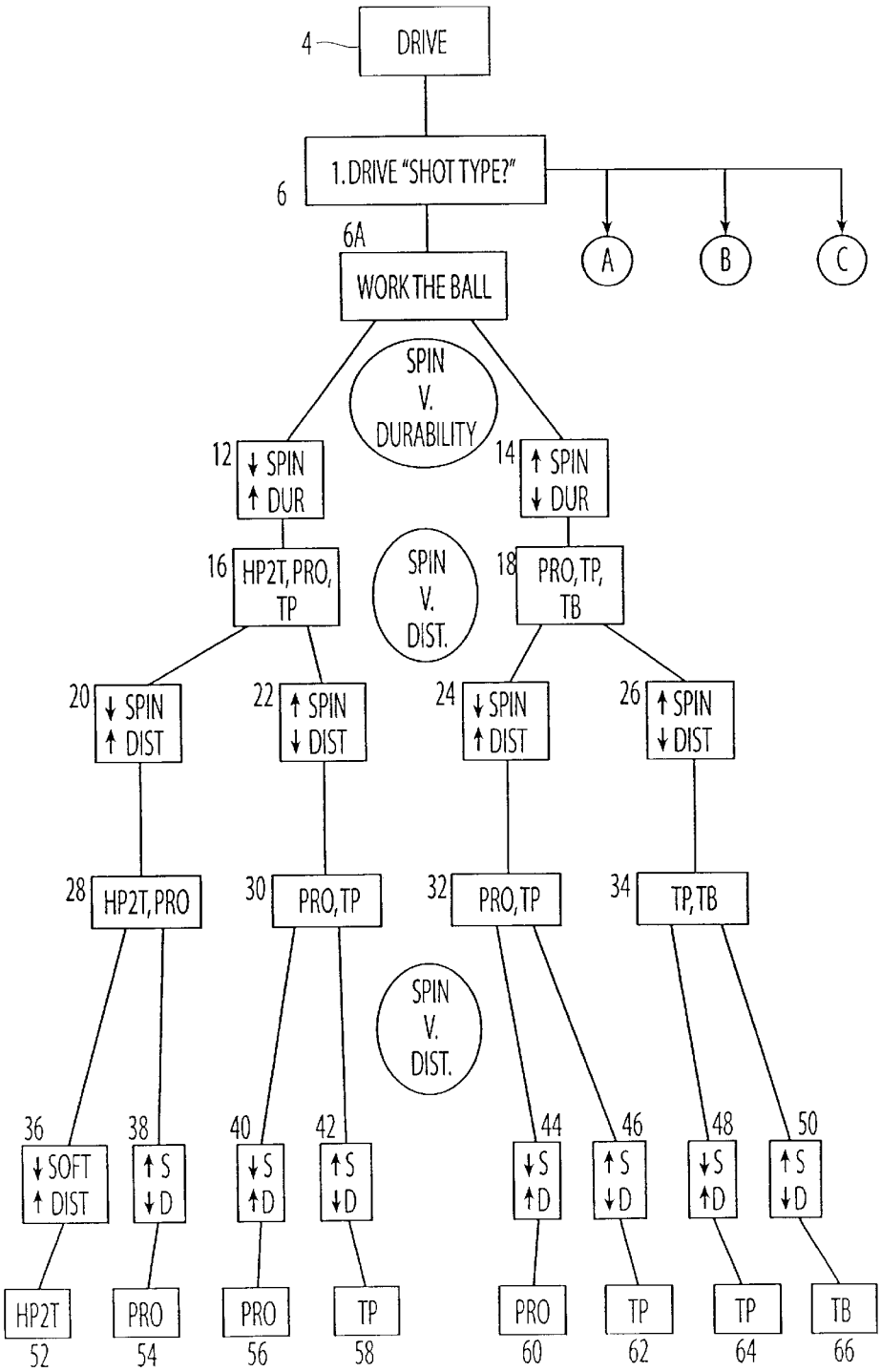
FIG. 2A is a decision tree depicting a first potential response of FIG. 1.
Figure 2B:
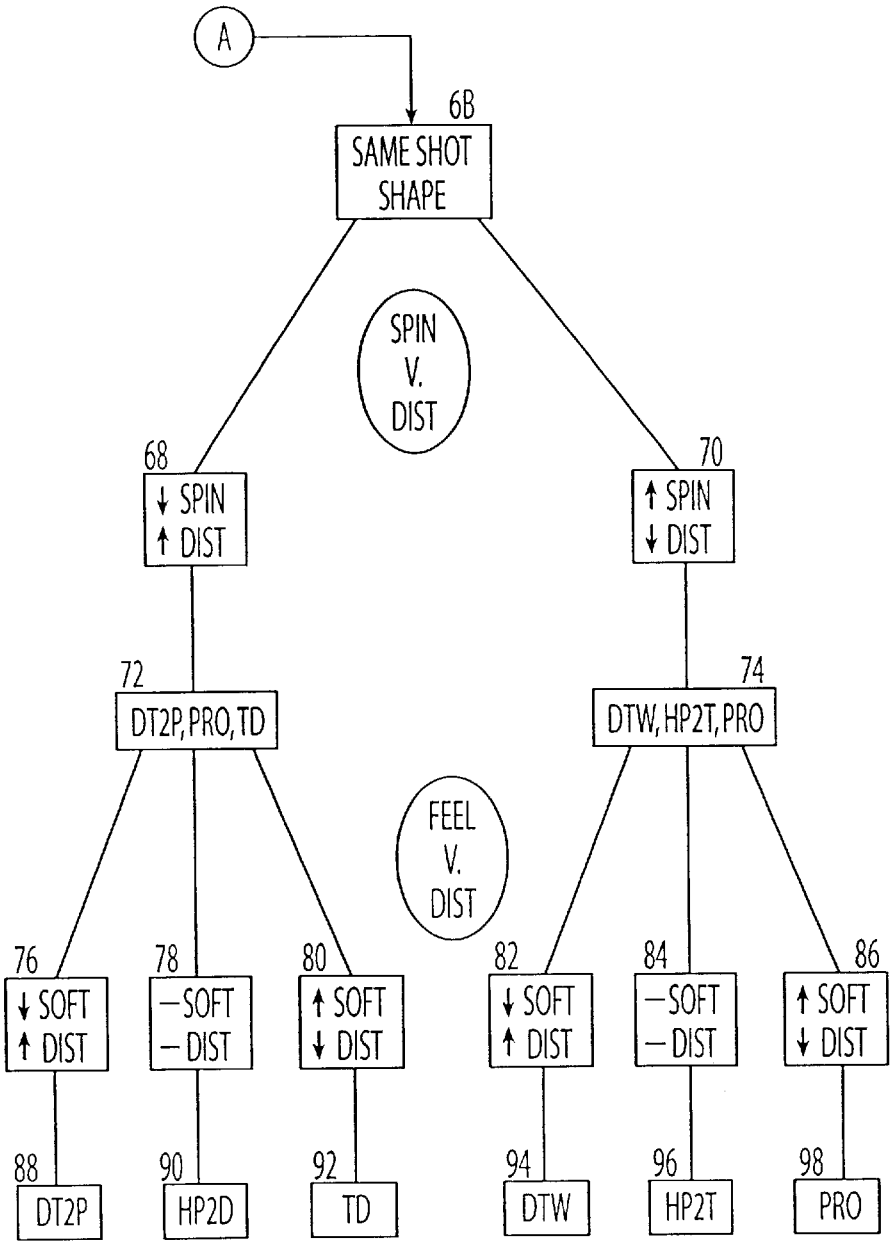
FIG. 2B is a decision tree depicting a second potential response of FIG. 2A.
Figure 2C:
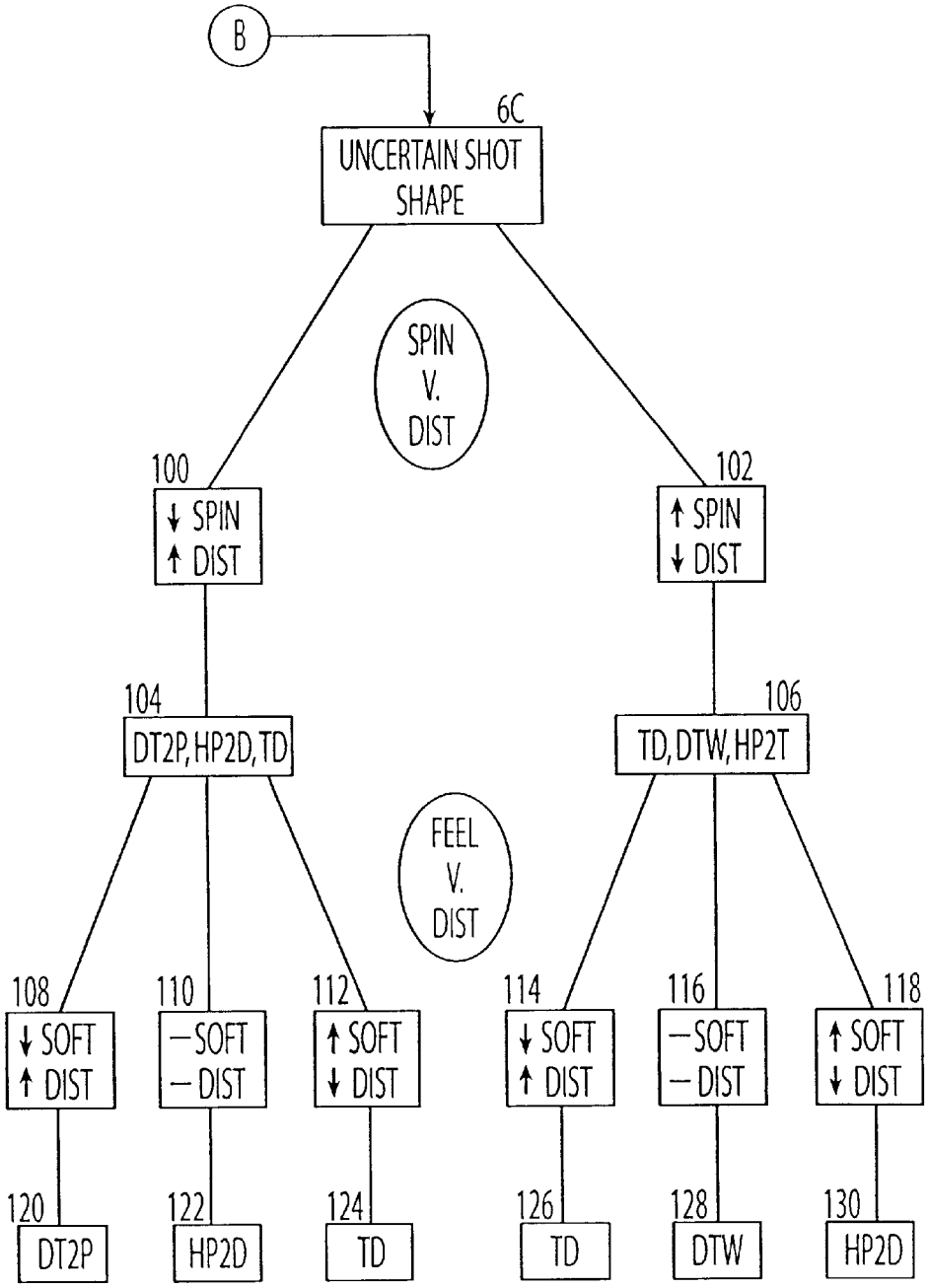
FIG. 2C is a decision tree depicting a third potential response of FIG. 2A.
Figure 2D:
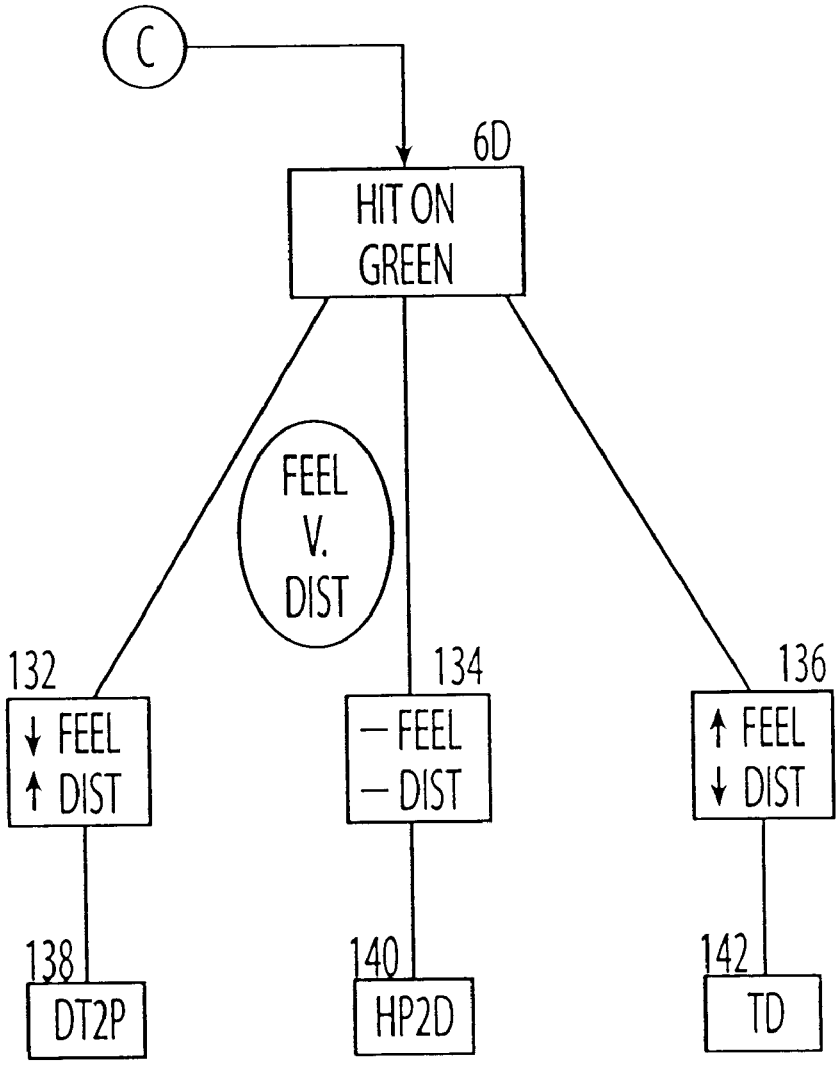
FIG. 2D is a decision tree depicting a fourth potential response of FIG. 2A.

In the preferred first step, the golfer's average driving distance is determined by prompting the golfer to select or input their average drive distance l. The golfer may input or select their preferred responses by a plurality of means such as using a computer input device such as a mouse or a keyboard, a telephone touch pad, by tactile input through a computer monitor, or by voice recognition. Preferably, the golfer's input or selection is accomplished with a computer mouse. Most preferably, it is determined whether the golfer's average drive distance is greater than 200 yards or less than 200 yards. If the golfer indicates that the average driver distance is greater than 200 yards, at least one question is presented to further aid in defining the golfer's critical playing characteristics and, subsequently, the ideal golf ball performance characteristics. The questions may include, but are not limited to, determining which shot most affects the golfer's score on a typical par 4 golf hole. In response to this at least one question, a plurality of options are presented to the golfer that further aid in defining the golfer's critical playing characteristics. In another embodiment, the questions are based on the golfer's selection or input based on other delimiters, such as swing speed, rather than drive distance. Referring to the decision tree set forth in FIG. 1, a plurality of options presented to the golfer that are critical to their score on a typical golf hole may include, but are not limited to, the drive or tee shot 2, the second shot or the approach shot 146, or the third shot 256, which typically includes the short game and/or chipping and putting around the green.

If it is determined that the drive or tee shot 2 is the most critical shot to the determining the golfer's score on a typical par 4, a plurality of options are presented for the golfer's input or selection that aid in describing or determining the typical shape of that shot. The options may include, but are not limited to working the ball (purposely drawing or fading the golf ball) 4, a consistent shot shape on every tee shot 6, an uncertain or varied shot shape (unpredictably drawing or fading the ball) 8, and difficulty keeping the ball in play (hit the golf ball out of play and/or lose a lot of golf balls) 10 (See FIG. 2).

Depending on the golfer's selection or entry, a subset of a plurality of golf balls can be presented having characteristics that would benefit a player selecting a particular group as the most influential shot.

The terms "working the ball" or "shaping a shot" refer to the intentional variation in a golf swing creating, on demand, a particular orientation and magnitude of lift force. The term "consistent shot shape" refers to a golf swing producing the same orientation of lift force while the magnitude of lift force may vary. The term "uncertain shot shape" refers to a golf swing limiting the magnitude of lift force while the orientation may vary. The term "difficulty keeping the ball in play" refers to a golfer who is unable to control either the magnitude or the orientation of the lift force. The term "dead straight" refers to controlling both the orientation of the lift force and does not produce a push or pull angle. For the purposes of fitting a ball to a player, the "dead straight" shot is included as a subset of players having a "consistent shot shape".

The shape of a golf shot is determined by two things: the initial direction of the golf ball and the effect of the lift force on the golf ball. The initial direction is literally the path of the golf ball expressed as the combination of launch angle and push or pull angle. Generally speaking, the push or pull angle is not considered as the "shape" of the shot, which is observed after the initial direction is established. The lift force has a magnitude and an orientation. If sufficiently large, the lift force can alter the direction of flight. In a perfect scenario in which the golf ball is struck squarely and leaves the clubface with zero push or pull angle and the axis of rotation is parallel to the ground and perpendicular to the intended path, the lift force causes the golf ball to rise above its initial direction.

In a less than perfect scenario, a golf ball leaves the clubface with either a push or a pull angle and the axis of rotation is inclined. As a result of the inclined axis of rotation, the lift force is not oriented "straight up" but is directed slightly to the left or right. The lift force causes the golf ball to curve (deviate from its initial direction) according to the inclined axis of rotation. The magnitude of the lift force is controlled by the spin and speed of the ball. Hence, the orientation and magnitude of the lift force create the shot shape.

Tremendous variation exists within the world of the golfers with regard to launch conditions produced. Push or pull angle, inclination of axis of rotation, ball speed, and spin, all vary. For this reason, tremendous variation in shot shape can be observed among golfers. When asked about their usual shot shape, unless a golfer responds that they hit it dead straight every time (also a consistent shot shape), they will respond with one of the above mentioned shot shape types.

The spin of a golf ball is the rate of rotation about a single axis of rotation when hit by a club. The axis of rotation may or may not be aligned with the target. In a squarely struck golf ball, the axis of rotation is parallel to the ground and perpendicular to the target line. In this scenario, the golf ball is described as having little or no side spin and flies in a relatively straight line. When the golf ball is not struck squarely, the axis of rotation has another orientation; it is inclined. In this scenario, the lift force is not only directed upwards but is likewise inclined, causing the golf ball to be directed left or right. The more inclined the axis of rotation, the greater the direction away from the target line.

If working the ball (purposely shaping the shot as required by the hole) 4 is the selection or entry of the golfer, the parent group of golf balls is narrowed to at least one subset of golf balls having preferred characteristics for a golfer who works the ball. Because distance is typically of lesser importance for golfers who work the ball, the parent group preferably contains a plurality of golf balls having softer covers, more spin, and good "feel." The subset preferably has fewer golf balls than the parent group. The users preferred golf ball is determined from the subset by the golfer by selecting golf ball performance characteristics from a first group comprising spin and "feel" and a second group comprising durability and distance.

Preferably, a preferred golf ball matching the golfer's golf ball performance characteristics is selected from the first subset of golf balls by the golfer expressing a preference of golf ball spin versus golf ball durability. Additionally, a preferred golf ball matching the golfer's golf ball performance characteristics is selected from a group of golf balls having varying weights. Preferably, the golf ball weights are distinguished by those being greater than about 1.58 ounces and those less than about 1.58 ounces. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability. It has been determined that the opposite correlation of ball characteristics best determines a golfer's ball performance characteristics. As shown below, this step can be repeated several times with different opposing characteristics to determine that which is most critical to the golfer's game and ultimate score.

For example, players preferring a golf ball having low spin and high durability 12, a group of golf balls that is a first subset 16 of the parent group can be determined. The size of the first subset 16 is less than the size of the parent group and the golf balls have characteristics that satisfy the golfers spin and durability preference. For players preferring a high spin golf ball having lower durability 14, a group of golf balls that is a second subset 18 of the parent group can be suggested. Preferably, the second subset 18 contains golf balls having softer cover material than the golf balls of the first subset 16. The size of the second subset 18 is preferably less than the size of the parent group and the golf balls have characteristics that closely match the golfer's preferred spin characteristics determined by opposing and durability characteristics. The second subset 18 preferably does not contain the same golf balls as the first subset 16.

After determining the golfer's spin and durability preferences, either the first or second subset 18 is narrowed to a preferred golf ball or at least two subsets by determining the golfer's golf ball performance characteristics by further comparing spin versus distance. For example, players preferring a golf ball having low spin and increased distance, 20 or 24, a group of golf balls that is a third subset, 28 and 32, of the first or second subsets is determined. The size of the subsets should be less than the size of the first or second subsets, 16 and 18, and the golf balls have characteristics that further satisfy the golfer's ball performance characteristics through the comparison of opposite spin and distance characteristics. For example, players preferring a high spin golf ball at the cost of some distance, 22 or 26, a group of golf balls that is a subset, 30 or 34, of the first or second subsets is recommended. The subsets 28, 30, 32, and 34 preferably contains different golf balls. The size of the third subset is less than the size of the first and second subsets, 16 and 18, and the golf balls have characteristics that further match the golfer's spin and distance preferences, as well as their spin and durability preferences.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

Depending on the golfer's selection or input regarding their spin and distance preferences, subsets 28, 30, 32, or 34 are further narrowed to at least two subsets by determining the golfer's ideal golf ball feel and distance characteristics. For example, players preferring less feel and greater distance, 36, 40, 44, or 48, a group of golf balls, 52, 56, 60, or 64, having at least one golf ball that is a subset of 28, 30, 32, or 34, is determined. The size of the subsets is less than the size of previous subsets and the golf balls have characteristics that are ideally matched to the golfer's spin and distance preference. For players preferring a golf ball having more feel and greater distance, 38, 42, 46 or 50, a group of golf balls 54, 58, 62, or 66, that is a subset of 28, 30, 32, or 34, is determined. The subsets 52–66 preferably does not contain different golf balls. The size of subsets 52–66 is preferably less than the size of parent subsets 28, 30, 32, or 34 and the golf balls have characteristics that ideally match the users feel and distance preferences as well as their spin and durability and spin and distance preferences.

In a preferred embodiment, the golfer makes the selection on a sliding scale, i.e., the golfer positions a marker on the 'feel' scale, which ranges from softer feel to firmer feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If the golfer enters or selects 'consistent shot shape' (purposely having the same shot shape) 6 to describe the typical shape of their tee shot, the parent group of golf balls having characteristics beneficial to the golfer having a consistent shot shape are determined. Because both distance and feel are of importance for golfers who have a consistent shot shape, the parent group preferably contains a plurality of golf balls having these as the primary characteristics. Preferably, at least one subset of golf balls, smaller than the parent group, is determined by the golfer expressing a preference of golf ball spin and distance characteristics.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having greater distance at some cost in spin, 68, a group of golf balls that is a first subset 72 of the parent group is determined. The size of the first subset 72 is less than the size of the parent group and the golf balls have characteristics that more closely match the golfer's golf ball spin and distance preference. For players preferring a golf ball that has higher spin at some cost in distance 70, a group of golf balls that is a second subset 74 of the parent group can be suggested. Preferably, the second subset 74 contains golf balls having softer cover material than the golf balls of the first subset 72. The size of the second subset 74 is preferably less than the size of the parent group and the golf balls have characteristics that closely match the golfer's spin and distance preference. The second subset 74 preferably does not contain the same golf balls as the first subset 72.

After determining the golf balls that ideally match the golfer's spin and distance preference, either the first or second subset, 72 or 74, is narrowed to at least two subsets by determining the golfer's preferred golf ball feel and distance characteristics. For example, players preferring a golf ball having increased distance but a harder feel, 76 or 82, a group of golf balls that is a subset, 88 or 94, of the first or second subsets, 72 or 74, is determined. The size of the subsets, 88 or 94, is less than the size of the first or second subsets, 72 and 74, and the golf balls have characteristics that further satisfy the golfer's desired feel and distance characteristics. For players preferring a golf ball having medium feel and distance characteristics, 78 or 84, a group of golf balls that is a subset, 90 or 96, of the first or second subsets, 72 or 74, is recommended. The size of the subsets is less than the size of the first or second subsets, 72 or 74, and the golf balls have characteristics that further match the golfer's preferred feel and distance characteristics. For players preferring a golf ball having softer feel at some cost in distance, 80 or 86, a group of golf balls that is a subset, 92 or 98, of the first or second subsets is determined. The size of the subsets is less than the size of the first or second subsets, 72 and 74, and the golf balls have characteristics that further satisfy the golfer's desired feel and distance characteristics. The subsets 88–98 preferably does not contain different golf balls. The size of the subsets is less than the size of the first and second subsets, 72 and 74, and the golf balls have characteristics that match both the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection.

The golfer's ideal feel versus distance setting may also be determined by positioning the distance marker, concurrently sliding the feel marker in opposite correlation to the distance selection.

If the golfer enters or selects 'uncertain shot shape' (inconsistent or varied shot shape off the tee but only with minor variations in direction) 8 to describe the typical shape of their tee shot, the parent group of golf balls having characteristics beneficial to the golfer having an inconsistent shot shape are determined. Because low spin is of importance for golfers who have an inconsistent shot shape (to aid in lessening the effect of spin which causes a hook or slice), the parent group preferably contains a plurality of golf balls having lower spin.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having low spin and greater distance 100, a group of golf balls that is a first subset 104 of the parent group is determined. The size of the first subset 104 is less than the size of the parent group and the golf balls have characteristics that match the golfer's spin and distance characteristics. For players preferring a golf ball that has high spin at some cost in distance 102, a group of golf balls that is a second subset 106 of the parent group is determined. Preferably, the second subset 106 contains golf balls having softer cover material than the golf balls of the first subset 104. The size of the second subset 106 is preferably less than the size of the parent group and the golf balls have characteristics that closely match the golfer's spin and distance preference. The second subset 106 preferably does not contain the same golf balls as the first subset 104.

Subsequent to determining the golfer's spin and distance preference, either the first or second subset, 104 or 106, is narrowed to at least two subsets by determining the golfer's preferred feel and distance characteristics. For example, players preferring a golf ball having harder feel and increased distance, 108 or 114, a group of golf balls that is a subset, 120 or 126, of the first or second subsets is determined. The size of the subsets is less than the size of the first or second subsets, 104 or 106, and the golf balls have characteristics that further satisfy the golfer's desired feel and distance characteristics. For players preferring a golf ball having medium feel and distance, 110 or 116, a group of golf balls that is a subset, 122 or 128, of the first or second subsets is recommended. The size of the subsets is less than the size of the first or second subsets, 104 or 106, and the golf balls have characteristics that further satisfy the golfer's desired feel and distance characteristics. For players preferring a golf ball having softer feel and less distance, 112 or 128, a group of golf balls that is a subset, 124 or 130, of the first or second subsets is determined. The size of the subsets is less than the size of the first or second subsets, 104 or 106, and the golf balls have characteristics that further satisfy the golfer's desired feel and distance characteristics. The subsets 120–130 preferably does not contain different golf balls. The size of the subsets is less than the size of the first and second subsets, 104 or 106, and the golf balls have characteristics that further match the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If the golfer enters or selects 'difficulty keeping the ball in play' (hit the golf ball out of play; major variations in direction) 10 to describe the typical shape of their tee shot, the parent group of golf balls having characteristics beneficial to the golfer having an inconsistent shot shape are determined. Because increased durability and distance, not high spin or soft feel, is of greater importance for golfers who have difficulty keeping the ball in play, the parent group preferably contains a plurality of golf balls having low spin and increased distance and durability.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

For example, players preferring a golf ball having harder feel and increased distance, 134, a group of golf balls that is a subset, 140, of the first subset is determined. The size of the subset is less than the size of the first subset, 132, and the golf balls have characteristics that best match the golfer's desired golf ball feel and distance characteristics. For players preferring a golf ball having medium feel and distance, 136, a group of golf balls that is a subset, 142, of the first subset is recommended. The size of the subset is less than the size of the first subset, 132, and the golf balls have characteristics that best match the golfer's desired golf ball feel and distance characteristics. For players preferring a golf ball having softer feel but less distance, 138, a group of golf balls that is a subset, 144, of the first subset is determined. The size of the subset is less than the size of the first subset, 132, and the golf balls have characteristics that best match the golfer's desired golf ball feel and distance characteristics. The subsets, 140, 142, and 144, preferably does not contain different golf balls. The size of the subsets is less than the size of the parent subset and the golf balls have characteristics that match the golfer's feel and distance preferences.

Figure 3A:
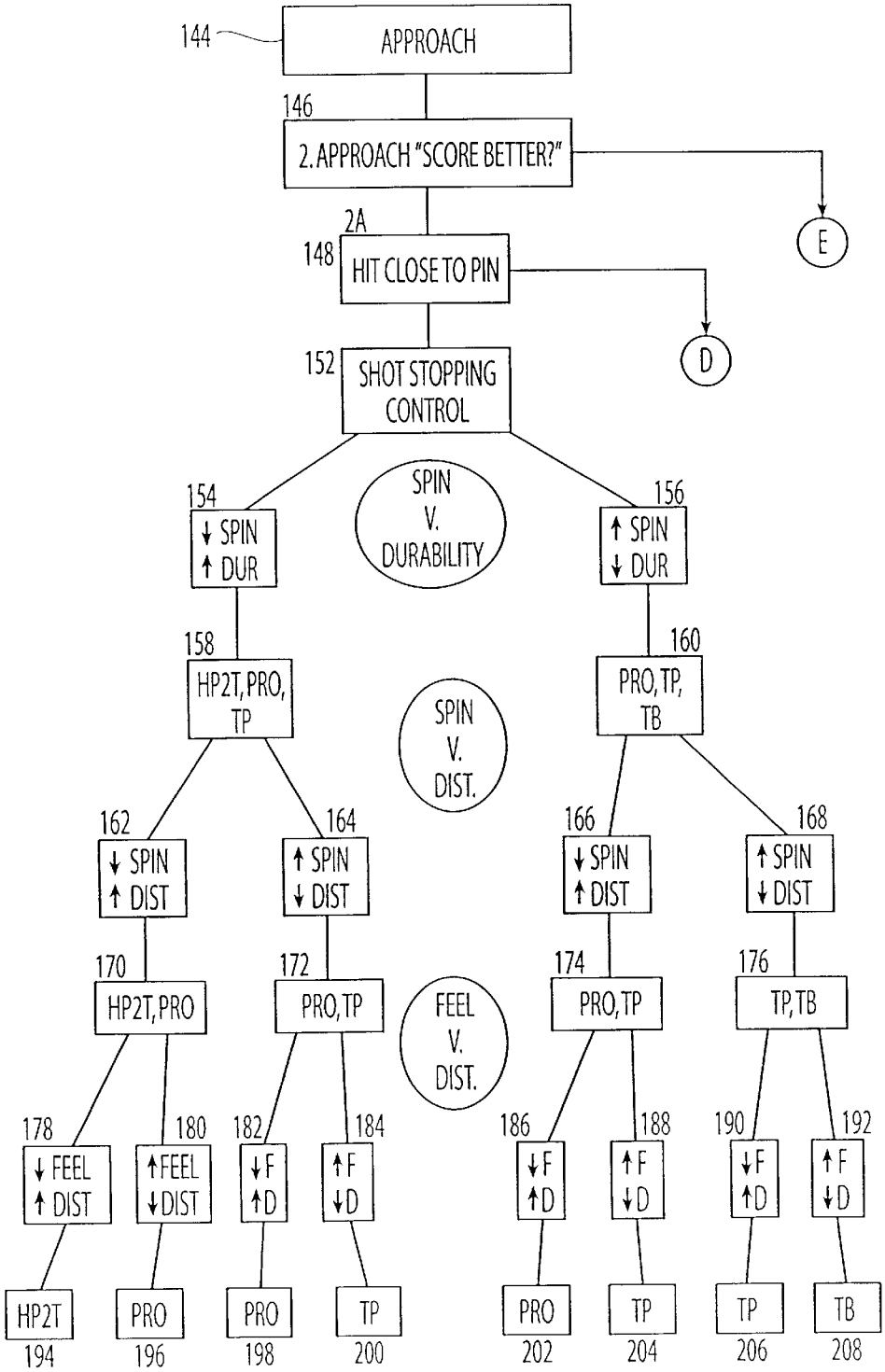
FIG. 3A is a decision tree depicting the second potential response of FIG. 1.
Figure 3B:
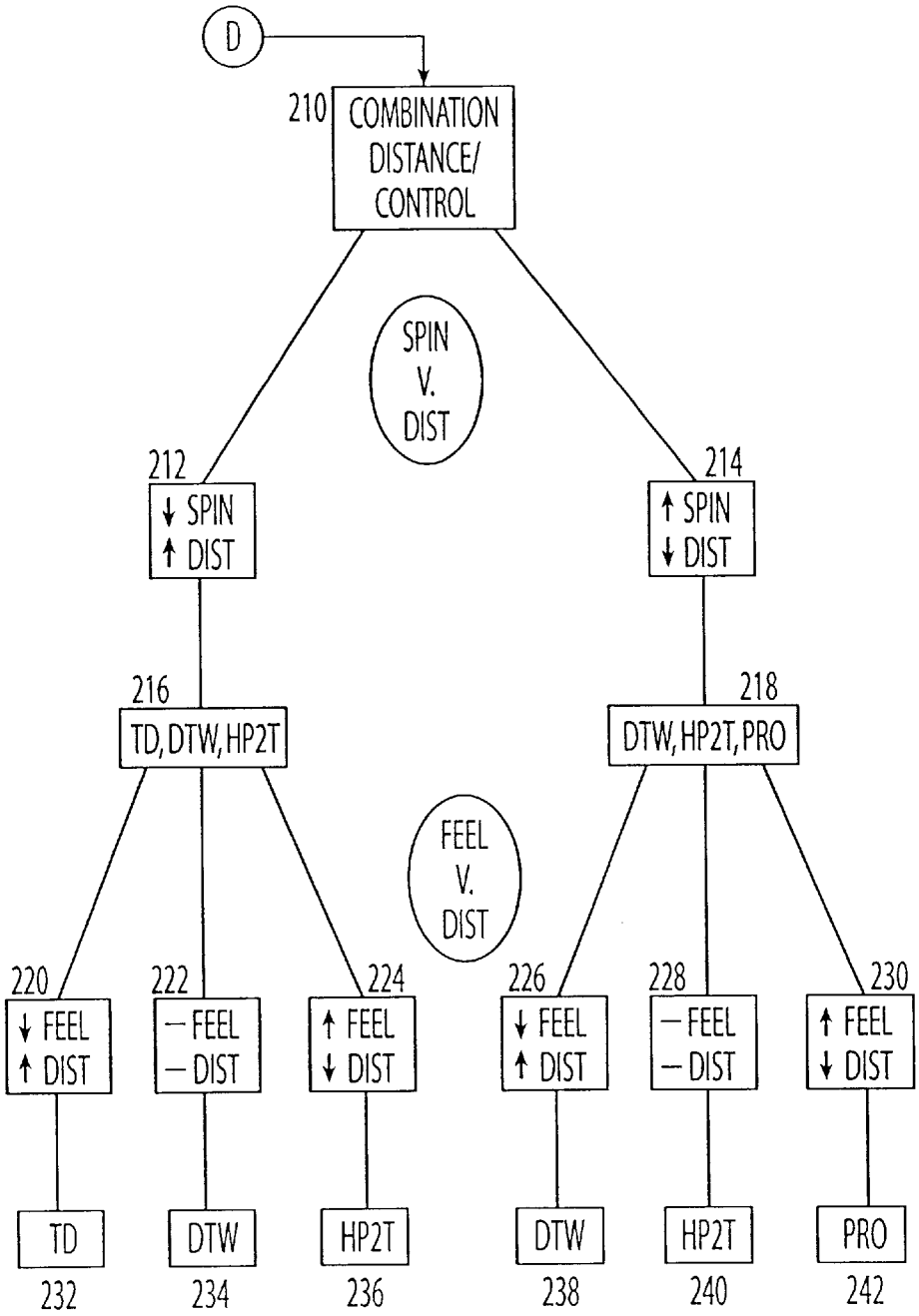
FIG. 3B is a decision tree depicting a second potential response of FIG. 3A.
Figure 3C:
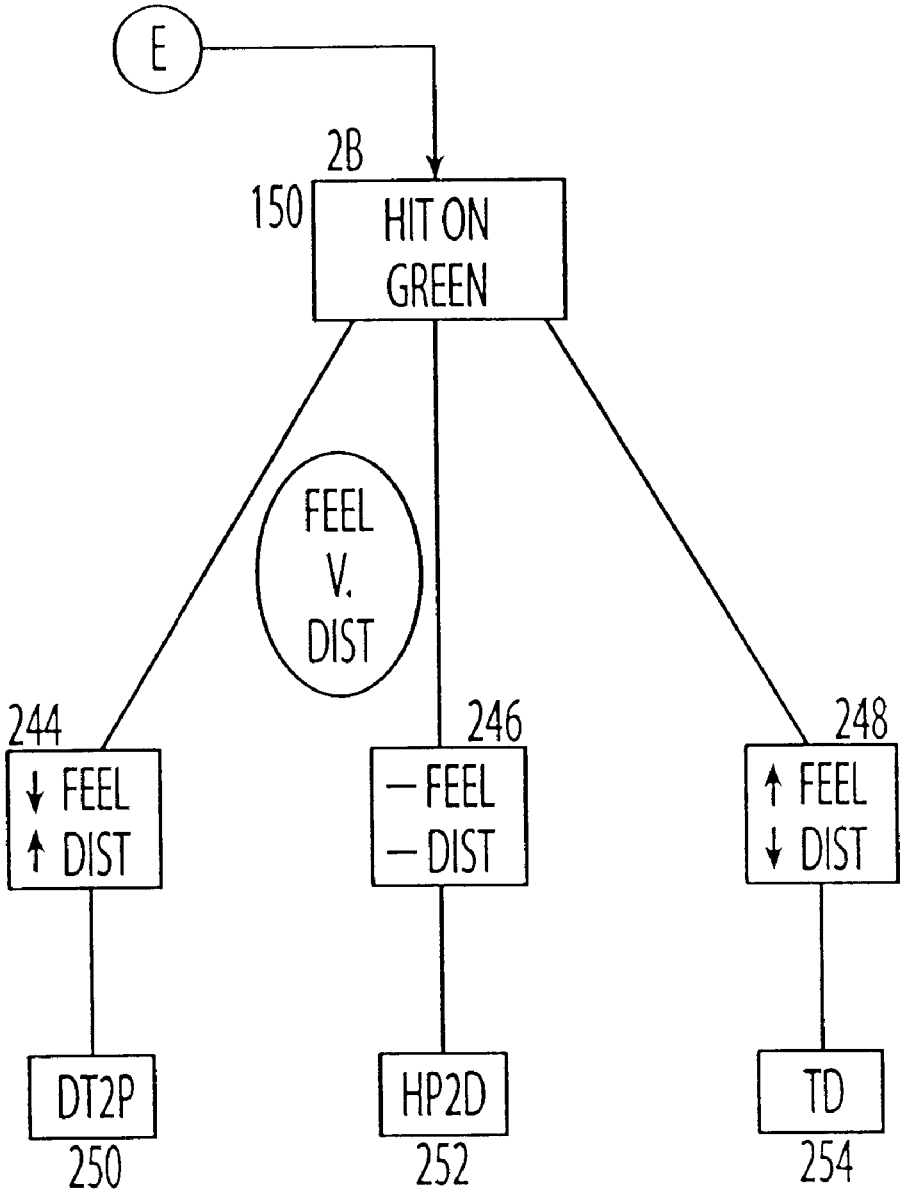
FIG. 3C is a decision tree depicting a third potential response of FIG. 3A.

If it is determined that the approach or second shot 146 is the most critical shot to the determining the golfer's score on a typical par 4, a plurality of options are presented for the golfer's input or selection that aid in describing or determining the most ideal golf ball for the golfer (See FIG. 3). The options may include, but are not limited to a consideration of whether a successful approach shot is defined as hitting the golf ball close to the pin 148 or simply hitting the golf ball on the green 150.

If the golfer's critical playing characteristics result in hitting the golf ball close to the pin 148, a parent group of golf balls having characteristics that are beneficial for that type of shot are determined. The golfer may then be asked to select or input the preferred nature of a typical shot close to the pin: whether they prefer shot-stopping control 152 or a combination of distance and control 210. The parent group of golf balls is narrowed to at least one subset of golf balls having preferred characteristics for a golfer who is very precise with the approach shot and wants shot-stopping control 152. Because golf ball feel and spin are of greater importance than is distance for golfers who play target golf, the parent group preferably contains a plurality of golf balls having softer and good "feel". The subset preferably has fewer golf balls than the parent group. The at least one subset is determined by the golfer by selecting critical golf ball characteristics from a first group comprising spin and "feel" and a second group comprising durability and distance. Preferably, a first subset of golf balls is determined by the golfer expressing a preference of golf ball spin versus golf ball durability. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability.

For example, players preferring low spin and high durability 154, a group of golf balls that is a first subset 158 of the parent group is determined. The size of the first subset 158 is less than the size of the parent group and the golf balls have characteristics that satisfy the golfers spin and durability preference. For players preferring a golf ball having high spin at the cost of durability 156, a group of golf balls that is a second subset 160 of the parent group can be suggested. Preferably, the second subset 160 contains golf balls having softer cover material than the golf balls of the first subset 158. The size of the second subset 160 is preferably less than the size of the parent group and the golf balls have characteristics that closely match the golfer's spin/durability preference. The second subset 160 preferably does not contain the same golf balls as the first subset 158. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability.

After determining the golfer's spin and durability preferences, either the first or second subset, 158 or 160, is narrowed to at least two subsets by determining the golfer's golf ideal spin versus distance preference. For players preferring a golf ball having increased distance at the cost of golf ball spin, 162 or 166, a group of golf balls that is a subset, 170 or 174, of the first or second subsets is determined. The size of the subsets is less than the size of the first or second subsets 158 or 160, and the golf balls have characteristics that further satisfy the golfer's desired spin and distance characteristics. For players preferring a high spin golf ball at the expense of some distance, 164 or 168, a group of golf balls that is a subset, 172 or 176, of the first or second subsets is recommended. The subsets, 170, 172, 174, or 176, preferably does not contain different golf balls. The size of the subsets is less than the size of the first and second subsets, 158 or 160, and the golf balls have characteristics that further match the golfer's spin and distance preferences, as well as their spin and durability preferences.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

Depending on the golfer's selection or input regarding their spin and distance preferences, subsets 170, 172, 174, or 176, are further narrowed to at least two subsets by determining the golfer's ideal value of "feel" versus distance. For example, players preferring greater distance at the cost of feel, 178, 182, 186, or 190, a group of golf balls, 194, 198, 202, or 206, having at least one golf ball that is a subset of 170, 172, 174, or 176 is determined. The size of the subsets is less than the size of previous subsets and the golf balls have characteristics that are ideally matched to the golfer's spin and distance preference. For players preferring a golf ball having more feel with less of a priority on distance, 180, 184, 188, 192, a group of golf balls 196, 200, 204, or 208, that is a subset of 170, 172, 174, or 176, is determined. The subsets 194–208 preferably does not contain different golf balls. The size of subsets 194–208 is preferably less than the size of subsets 170, 172, 174, or 176, and the golf balls have characteristics that ideally match the users feel and distance preferences as well as their spin and durability and spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If the golfer prefers hitting the golf ball close to the pin 148 and their critical playing characteristic is preferably a combination of distance and control 210, the parent group of golf balls is narrowed to at least one subset of golf balls having preferred characteristics for a golfer who prefers a combination of distance and control 210. Preferably, the golfer is asked to input or select their desired golf ball spin and distance characteristics.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having greater distance at the sacrifice of some spin 212, a group of golf balls that is a first subset 216, of a parent group of golf balls is determined. The size of the first subset 216 is less than the size of the parent group and the golf balls have characteristics that satisfy the golfer's spin and distance preference. For players preferring a golf ball that has high spin at the sacrifice of some distance 214, a group of golf balls that is a second subset 218 of the parent group can be suggested. Preferably, the second subset 218 contains golf balls having softer cover material than the golf balls of the first subset 216. The size of the second subset 218 is preferably less than the size of the parent group and the golf balls have characteristics that closely match the golfer's spin and distance preference. The second subset 218 preferably does not contain the same golf balls as the first subset 216.

After determining the golfer's spin and distance preference, either the first 216 or second 218 subset is narrowed to at least two subsets by determining the golfer's ideal feel versus distance preference. For example, players preferring a golf ball having increased distance while foregoing some feel, 220 or 226, a group of golf balls that is a subset, 232 or 238, of the first or second subsets is determined. The size of the subsets is less than the size of the first or second subsets, 216 or 218, and the golf balls have characteristics that further satisfy the golfer's desired feel and distance characteristics. For players preferring a golf ball having medium feel and distance, 222 or 228, a group of golf balls that is a subset, 234 or 240, of the first or second subsets is recommended. The size of the subsets is less than the size of the first or second subsets, 216 or 218, and the golf balls have characteristics that further satisfy the golfer's desired feel and distance characteristics. For players preferring a golf ball having softer feel at the expense of some distance, 224 or 230, a group of golf balls that is a subset, 236 or 242, of the first or second subsets is determined. The size of the subsets is less than the size of the first or second subsets, 216 or 218, and the golf balls have characteristics that further satisfy the golfer's desired feel and distance characteristics. The subsets 232–242 preferably does not contain different golf balls. The size of the subsets is less than the size of the first and second subsets, 216 or 218, and the golf balls have characteristics that further match the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If it is determined that the approach or second shot 146 is the most critical shot to the determining the golfer's score on a typical par 4, a plurality of options are presented for the golfer's input or selection that aid in describing or determining the most ideal golf ball for the golfer. The golfer is preferably asked to input or select what typically makes them score better. The options may include, but are not limited to hitting the golf ball close to the pin 148 or aiming and hitting the golf ball on the green 150. If the golfer inputs or selects hitting the ball on the green 150, the golfer is queried as to the preferred characteristics of golf ball feel versus distance.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

For example, players preferring a golf ball having increased distance at the expense of feel, 244, a group of golf balls that is a subset, 250, of the first subset is determined. The size of the subset is less than the size of the parent group and the golf balls have characteristics that further satisfy the golfer's desired feel and distance characteristics. For players preferring a golf ball having medium feel and distance, 246, a group of golf balls that is a subset, 252, of the first subset is recommended. The size of the subsets is less than the size of the parent group and the golf balls have characteristics that further satisfy the golfer's desired feel and distance characteristics. For players preferring a golf ball having softer feel with less distance, 248, a group of golf balls that is a subset, 254, of the first subset is determined. The size of the subsets is less than the size of the parent group and the golf balls have characteristics that further satisfy the golfer's desired feel and distance characteristics. The subsets, 250, 252, and 254, preferably does not contain different golf balls.

If it is determined that the third shot (chipping and pitching the golf ball near the green; the short game ability) 256 is the most critical shot to the determining the golfer's score on a typical par 4, a plurality of options are presented for the golfer's input or selection that aid in describing or determining the most ideal golf ball for the golfer. The options may include, but are not limited to whether they prefer shot-stopping control 258 or a combination of distance and control 260. The parent group of golf balls is narrowed to at least one subset of golf balls having preferred characteristics for a golfer who is very precise with the approach shot and wants shot-stopping control. Because golf ball feel and spin are of greater importance than is distance for golfers whose scores are most affected by the short game ability, chipping and putting, the parent group preferably contains a plurality of golf balls having softer "feel" and therefore, more spin. At least one subset is determined by the golfer by selecting preferred golf ball characteristics from a first group comprising spin and "feel" and a second group comprising durability and distance. Preferably, a first subset of golf balls is determined by the golfer expressing a preference of golf ball spin versus golf ball durability. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability.

For example, players preferring a low spin ball and high durability 262, a group of golf balls that is a first subset, 266, of the parent group is determined. The size of the first subset 266 is less than the size of the parent group and the golf balls have characteristics that satisfy the golfers spin and durability preference. For players preferring a golf ball having high spin at some cost in durability 264, a group of golf balls that is a second subset 268 of the parent group can be suggested. Preferably, the second subset 268 contains golf balls having softer cover material than the golf balls of the first subset 266. The size of the second subset 268 is preferably less than the size of the parent group and the golf balls have characteristics that closely match the golfer's spin and durability preference. The second subset 268 preferably does not contain the same golf balls as the first subset 266. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability.

After determining the golfer's spin and durability preferences, either the first or second subset, 266 or 268, is narrowed to at least two subsets by determining the golfer's ideal golf ball spin and distance characteristics. For example, players preferring a golf ball having increased distance at the cost of golf ball spin, 270 or 274, a group of golf balls that is a subset, 278 or 282, of the first or second subsets is determined. The size of the subsets is less than the size of the first or second subsets, 266 or 268, and the golf balls have characteristics that further satisfy the golfer's desired spin and distance characteristics. For players preferring a high spin golf ball at the expense of some distance, 272 or 276, a group of golf balls that is a subset, 280 or 284, of the first or second subsets is recommended. The subsets, 278, 280, 282, or 284, preferably does not contain different golf balls. The golf balls have characteristics that further match the golfer's spin and distance preferences, as well as their spin and durability preferences.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

Depending on the golfer's selection or input regarding their spin and distance preferences, subsets 278, 280, 282, or 284, arc further narrowed to at least two subsets by determining the golfer's ideal golf ball feel and distance characteristics. For example, players preferring greater distance at the cost of feel, 286, 290, 294, or 298, a group of golf balls, 302, 306, 310, or 314, having at least one golf ball that is a subset of 278, 280, 282, or 284 is determined. The size of the subsets is less than the size of previous subsets and the golf balls have characteristics that are ideally matched to the golfer's spin and distance preference. For players preferring a golf ball having more feel with less of a priority on distance, 288, 292, 296, or 300, a group of golf balls 304, 308, 312, or 316, that is a subset of 278, 280, 282, or 284, is determined. The subsets 302–316 preferably does not contain different golf balls. The size of subsets 302–316 is preferably less than the size of subsets 278, 280, 282, or 284, and the golf balls have characteristics that ideally match the users feel and distance preferences as well as their spin and durability and spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

Figure 4A:
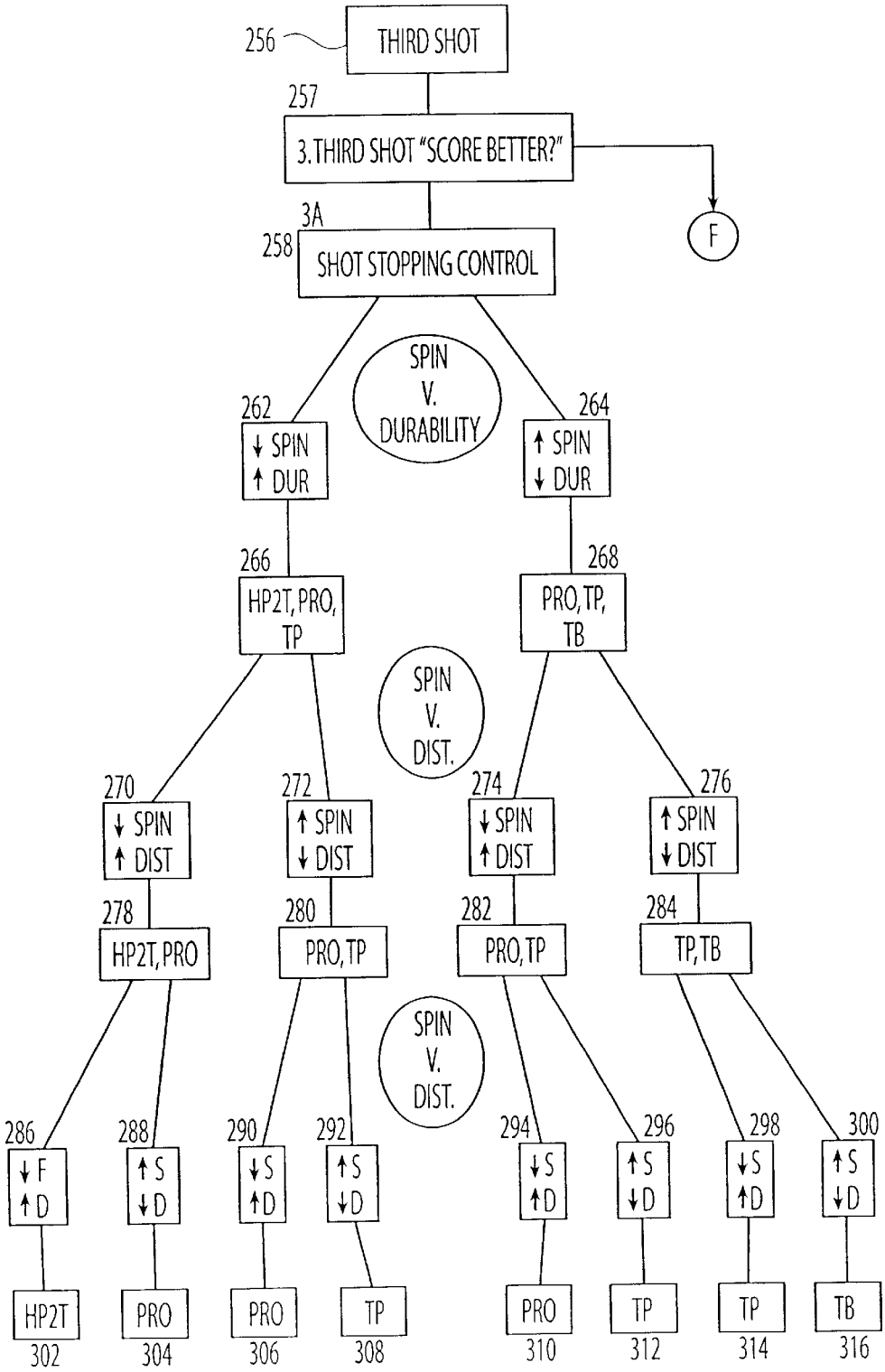
FIG. 4A is a decision tree depicting the third potential response of FIG. 1.
Figure 4B:
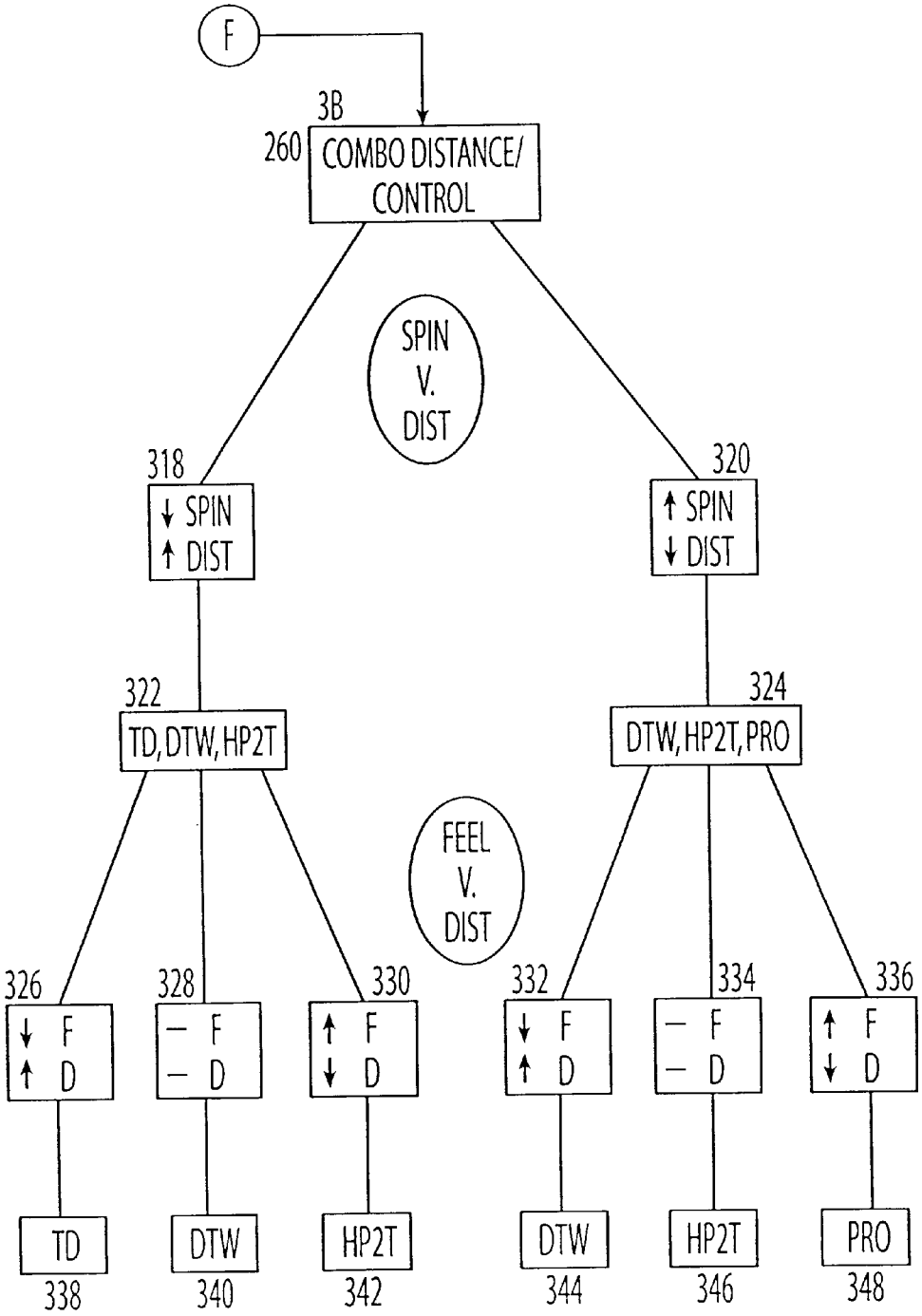
FIG. 4B is a decision tree depicting a second potential response of FIG. 4A.

If it is determined that the third shot (chipping and pitching the golf ball near the green; the short game ability) 256 is the most critical shot to the determining the golfer's score on a typical par 4, a plurality of options are presented for the golfer's input or selection that aid in describing or determining the most ideal golf ball for the golfer (See FIG. 4). The options may include, but are not limited to whether they prefer shot-stopping control 258 or a combination of distance and control 260. If the golfer prefers a combination of distance and control 260, a parent group of golf balls having characteristics that are beneficial for that type of shot are determined. Preferably, the golfer is asked to input or select their desired golf ball spin and distance characteristics.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having greater distance at the sacrifice of some spin 318, a group of golf balls that is a first subset 322, of a parent group of golf balls is determined. The size of the first subset 322 is less than the size of the parent group and the golf balls have characteristics that satisfy the golfer's spin and distance preference. For players preferring a golf ball that has high spin at the sacrifice of some distance 320, a group of golf balls that is a second subset 324 of the parent group can be suggested. Preferably, the second subset 324 contains golf balls having softer cover material than the golf balls of the first subset 322 The size of the second subset 324 is preferably less than the size of the parent group and the golf balls have characteristics that closely match the golfer's spin and distance preference. The second subset 324 preferably does not contain the same golf balls as the first subset 322.

After determining the golfer's spin and distance preference, either the first 322 or second 324 subset is narrowed to at least two subsets by determining the golfer's ideal golf ball feel and distance characteristics. For example, players preferring a golf ball having increased distance while foregoing some feel, 326 or 332, a group of golf balls that is a subset, 338 or 344, of the first or second subsets can be determined. The size of the subsets is less than the size of the first or second subsets, 322 or 324, and the golf balls have characteristics that further satisfy the golfer's desired feel and distance characteristics. For players preferring a golf ball having medium feel and distance, 328 or 334, a group of golf balls that is a subset, 340 or 346, of the first or second subsets is recommended. The size of the subsets is less than the size of the first or second subsets, 322 or 324, and the golf balls have characteristics that further satisfy the golfer's desired feel and distance characteristics. For players preferring a golf ball having softer feel at the expense of some distance, 330 or 336, a group of golf balls that is a subset, 342 or 348, of the first or second subsets can be determined. The size of the subsets is less than the size of the first or second subsets, 322 or 324, and the golf balls have characteristics that further satisfy the golfer's desired feel and distance characteristics. The subsets 338–348 preferably does not contain different golf balls. The size of the subsets is less than the size of the first and second subsets, 322 or 324, and the golf balls have characteristics that further match the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic can be determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

Figure 5A:
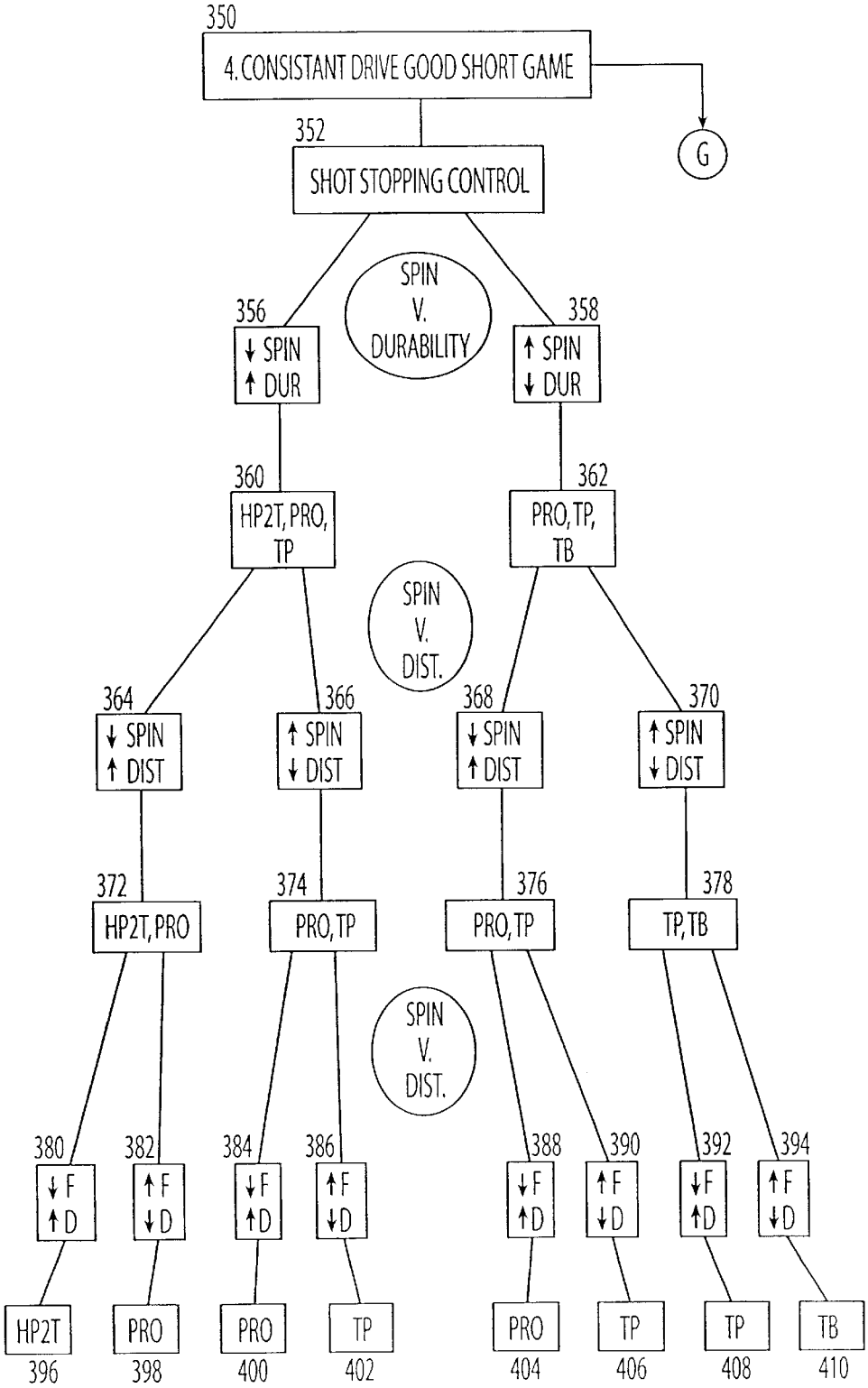
FIG. 5A is a decision tree depicting the fourth potential response of FIG. 1.
Figure 5B:
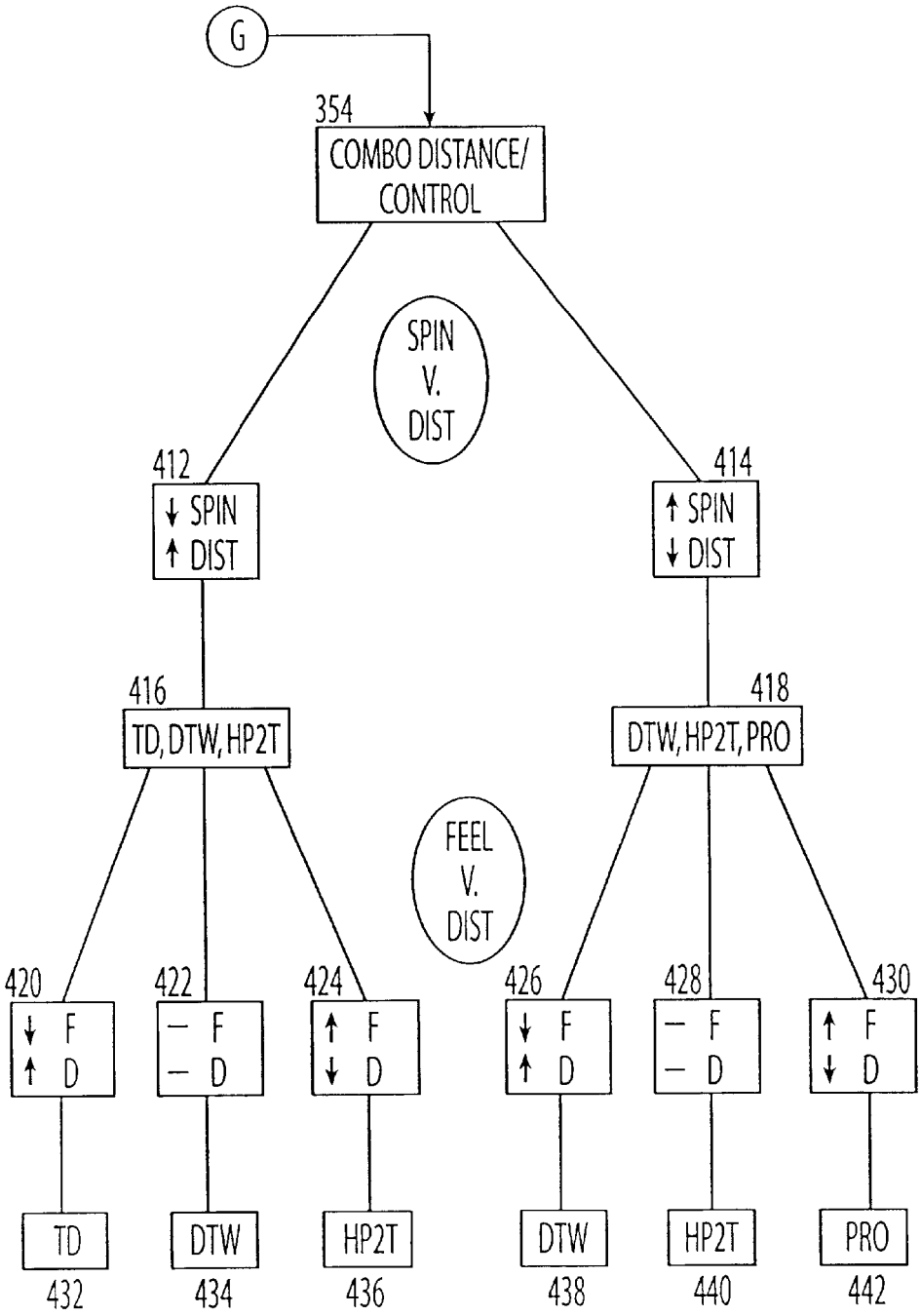
FIG. 5B is a decision tree depicting a second potential response of FIG. 5A.

If the golfer indicates that the average driver distance is less than 200 yards, at least one question is presented to further aid in defining the golfer's critical playing characteristics and, subsequently, the ideal golf ball and ball characteristics. The questions may include, but are not limited to, determining which description most closely describes the golfer's type of play. In response to this at least one question, a plurality of options are presented to the golfer that further aid in defining the golfer's critical playing characteristics. Referring to the decision tree set forth in FIG. 5, a plurality of options presented to the golfer that describe their style of play may include, but are not limited to, having a consistent drive along with a good short game ability 350 and being an emerging or challenged player 444.

If it is determined that having a consistent drive along with a good short game ability 350 best describes the golfer's style of play, a plurality of options are presented for the golfer's input or selection that aid in describing or determining which shot, on approach shots, is most likely to help the golfer score better. The options may include, but are not limited to having shot-stopping control 352 and having a combination of distance and control 354. Depending on the golfer's selection or entry, a subset of a plurality of golf balls can be presented having characteristics that would benefit a player selecting a particular group as the most influential shot.

If having shot-stopping control 352 is the selection or entry of the golfer, the parent group of golf balls is narrowed to at least one subset of golf balls having preferred characteristics for a golfer who works the ball. Because distance is of lesser importance for golfers who prefer shot-stopping control, the parent group preferably contains a plurality of golf balls having softer covers, more spin, and good "feel". The subset preferably has fewer golf balls than the parent group. The users preferred golf ball is determined from the subset by the golfer by selecting critical golf ball characteristics from a first group comprising spin and "feel" and a second group comprising durability and distance. Preferably, a preferred golf ball matching the golfer's critical golf ball characteristics is selected from the first subset of golf balls by the golfer expressing a preference of golf ball spin versus golf ball durability. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability. It has been determined that the opposite correlation of ball characteristics best determines a golfer's ball performance characteristics. As shown below, this step can be repeated several times with different opposing characteristics to determine that which is most critical to the golfer's game and ultimate score.

For example, players preferring low spin and high durability 356, a group of golf balls that is a first subset 360 of the parent group can be determined. The size of the first subset 360 is less than the size of the parent group and the golf balls have characteristics that satisfy the golfers spin and durability preference. For players preferring a high spin golf ball having lower durability 358, a group of golf balls that is a second subset 362 of the parent group can be suggested. Preferably, the second subset 362 contains golf balls having softer cover material than the golf balls of the first subset 360 The size of the second subset 362 is preferably less than the size of the parent group and the golf balls have characteristics that closely match the golfer's spin critical characteristics determined by opposing and durability characteristics. The second subset 362 preferably does not contain the same golf balls as the first subset 360.

After determining the golfer's spin and durability preferences, either the first or second subset, 360 or 362, is narrowed to a preferred golf ball or at least two subsets by determining the golfer's critical golf ball characteristics by further comparing spin versus distance preferences. For example, players preferring a golf ball having low spin and increased distance, 364 or 368, a group of golf balls that is a third subset, 372 or 376, of the first or second subsets is determined. The size of the subsets should be less than the size of the first or second subsets, 360 or 362, and the golf balls have characteristics that further satisfy the golfer's ball performance characteristics through the comparison of opposite spin and distance characteristics. For example, players preferring a high spin golf ball at the cost of some distance, 366 or 370, a group of golf balls that is a subset, 374 or 378, of the first or second subsets is recommended. The subsets 372, 374, 376, or 378 preferably contain different golf balls. The size of the third subset is less than the size of the first and second subsets, 360 or 362, and the golf balls have characteristics that further match the golfer's spin and distance preferences, as well as their spin and durability preferences.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

Depending on the golfer's selection or input regarding their spin and distance preferences, subsets 372, 374, 376, or 378 are further narrowed to at least two subsets by determining the golfer's ideal golf ball feel and distance characteristics. For example, players preferring less feel and greater distance, 380, 384, 388, or 392, a group of golf balls, 396, 400, 404, or 408, having at least one golf ball that is a subset of 372, 374, 376, or 378, is determined. The size of the subsets is less than the size of previous subsets and the golf balls have characteristics that are ideally matched to the golfer's spin and distance preference. For players preferring a golf ball having more feel and greater distance, 382, 386, 390, or 394, a group of golf balls 398, 402, 406, or 410, that is a subset of 372, 374, 376, or 378, is determined. The subsets 396–410 preferably do not contain different golf balls. The size of subsets 396–410 is preferably less than the size of parent subsets 372, 374, 376, or 378 and the golf balls have characteristics that ideally match the users feel and distance preferences as well as their spin and durability and spin and distance preferences.

In a preferred embodiment, the golfer makes the selection on a sliding scale, i.e., the golfer positions a marker on the 'feel' scale, which ranges from softer feel to firmer feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If having a combination of distance and control 354 is the selection of the golfer, a parent group of golf balls having said characteristics is determined. Because both distance and feel are of importance for golfers who desire a combination of distance and control, the parent group preferably contains a plurality of golf balls having these as the primary characteristics. Preferably, at least one subset of golf balls, smaller than the parent group, is determined by the golfer expressing a preference of golf ball spin and distance characteristics.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having greater distance at some cost in spin, 412, a group of golf balls that is a first subset 416 of the parent group is determined. The size of the first subset 416 is less than the size of the parent group and the golf balls have characteristics that more closely match the golfer's golf ball spin and distance preference. For players preferring a golf ball that has higher spin at some cost in distance 414, a group of golf balls that is a second subset 418 of the parent group can be suggested. Preferably, the second subset 418 contains golf balls having softer cover material than the golf balls of the first subset 416. The size of the second subset 418 is preferably less than the size of the parent group and the golf balls have characteristics that closely match the golfer's spin and distance preference. The second subset 418 preferably does not contain the same golf balls as the first subset 416.

After determining the golf balls that ideally match the golfer's spin and distance preference, either the first or second subset, 416 or 418, is narrowed to at least two subsets by determining the golfer's preferred golf ball feel and distance characteristics. For example, players preferring a golf ball having increased distance but a harder feel, 420 or 426, a group of golf balls that is a subset, 432 or 438, of the first or second subsets, 416 or 418, is determined. The size of the subsets, 432 or 438, is less than the size of the first or second subsets, 416 or 418, and the golf balls have characteristics that further satisfy the golfer's desired feel and distance characteristics. For players preferring a golf ball having medium feel and distance characteristics, 422 or 428, a group of golf balls that is a subset, 434 or 440, of the first or second subsets, 416 or 418, is recommended. The size of the subsets is less than the size of the first or second subsets, 416 or 418, and the golf balls have characteristics that further satisfy the golfer's critical golf ball feel and distance characteristics. For players preferring a golf ball having softer feel at some cost in distance, 424 or 430, a group of golf balls that is a subset, 436 or 442, of the first or second subsets is determined. The size of the subsets is less than the size of the first or second subsets, 416 or 418, and the golf balls have characteristics that further satisfy the golfer's desired feel and distance characteristics. The subsets 432–442 preferably does not contain different golf balls. The size of the subsets is less than the size of the first and second subsets, 416 or 418, and the golf balls have characteristics that match both the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

Figure 6:
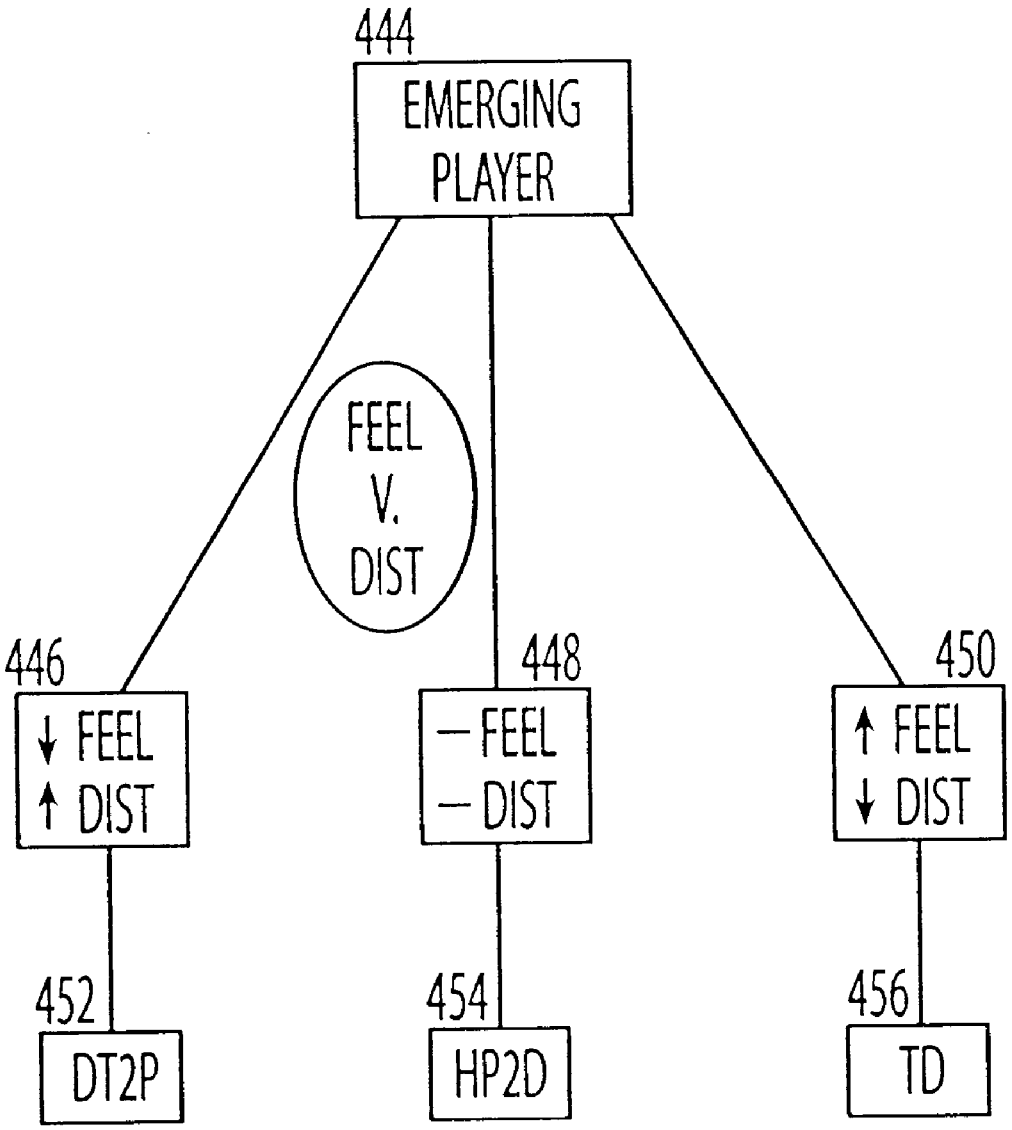
FIG. 6 is a decision tree depicting the fifth potential response of FIG. 1.

If the golfer enters or selects 'emerging or challenged player' 444 to describe their type or style of play, the parent group of golf balls having characteristics beneficial to the golfer having said style is determined (See FIG. 6). Because increased durability and distance, not high spin or soft feel, is of greater importance for golfers who are challenged or are learning the game of golf, the parent group preferably contains a plurality of golf balls having low spin and increased distance and durability.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

For example, players preferring a golf ball having harder feel and increased distance, 446, a group of golf balls that is a subset, 452, of the parent group is determined. The size of the subset is less than the size of the parent group and the golf balls have characteristics that best match the golfer's desired golf ball feel and distance characteristics. For players preferring a golf ball having medium feel and distance, 448, a group of golf balls that is a subset, 454, of the parent group is recommended. The size of the subset is less than the size of the parent group and the golf balls have characteristics that best match the golfer's desired golf ball feel and distance characteristics. For players preferring a golf ball having softer feel but less distance, 450, a group of golf balls that is a subset, 456, of the parent group is determined. The size of the subset is less than the size of the parent group and the golf balls have characteristics that best match the golfer's desired golf ball feel and distance characteristics. The subsets, 452, 454, or 456, preferably do not contain different golf balls. The size of the subsets is less than the size of the parent subset and the golf balls have characteristics that match the golfer's feel and distance preferences.

In another embodiment of the present invention, following the determination of the golf ball that is best suited to the golfer's preferred playing characteristics, at least one additional interactive process is available for the golfer to interact with the golf ball manufacturer. It is preferred that the number of interactions between the golfer and manufacturer be greater than about 1. The additional interactions may be accomplished by any method available to one skilled in the art, such as via a CD-ROM, internet access and/or web site, or a programmed microchip. Preferably, the golfer interacts with the manufacturer over the internet.

In the iterative interaction embodiment, the golfer is queried whether or not they have determined a golf ball that best matches their critical playing characteristics by, for example, the method as described above and depicted in FIGS. 1–6. The golfer may be queried and/or asked for a response in a number of manners, such as by "logging into" a web site provided by the manufacturer, i.e., www.titleist.com. After determining their preferred golf ball, the golfer is encouraged to test the selection and return to the interactive media for further input regarding their decision. The golfer may then be queried for information for profiling and storage in a database, such as on a hard drive, recordable CD-ROM, or a floppy disk. Such information may include, but are not limited to, for example, the golfer's name, address, email address, primary golf course, handicap, frequency of play, and primary golf ball model.

In a preferred embodiment, the golfer is additionally queried as to the originally recommended or suggested golf ball that best fit their critical playing characteristics and, along those lines, whether the recommended golf ball was a good recommendation and/or will the golfer continue to play the recommended golf ball. Based on the golfer's response, preferably the golfer is either given an opportunity to "fine tune" the original suggestion or to answer a plurality of questions regarding the original selection. It is preferred that the questions regarding the original selection, if the golfer was satisfied, are directed to comparing the selection to the golfer's previously played golf ball. In this manner, the manufacturer can gather information useful for construction and/or modification of new golf balls that better match the preferred characteristics golfers desire.

Figure 7:
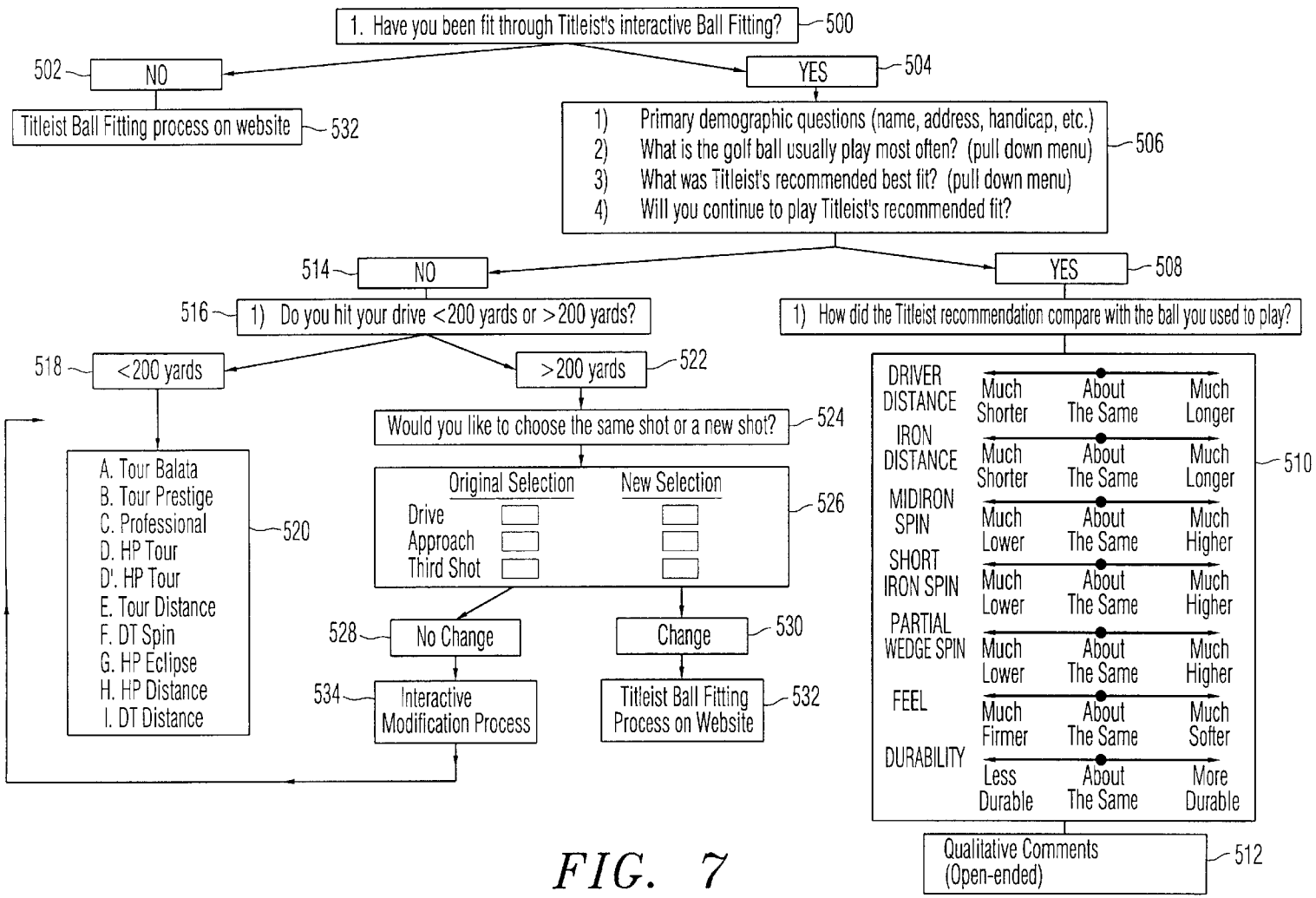
FIG. 7 is a decision tree of another embodiment of the present invention showing an interactive and iterative method for further refining a golf ball best fit.
Figure 8A:
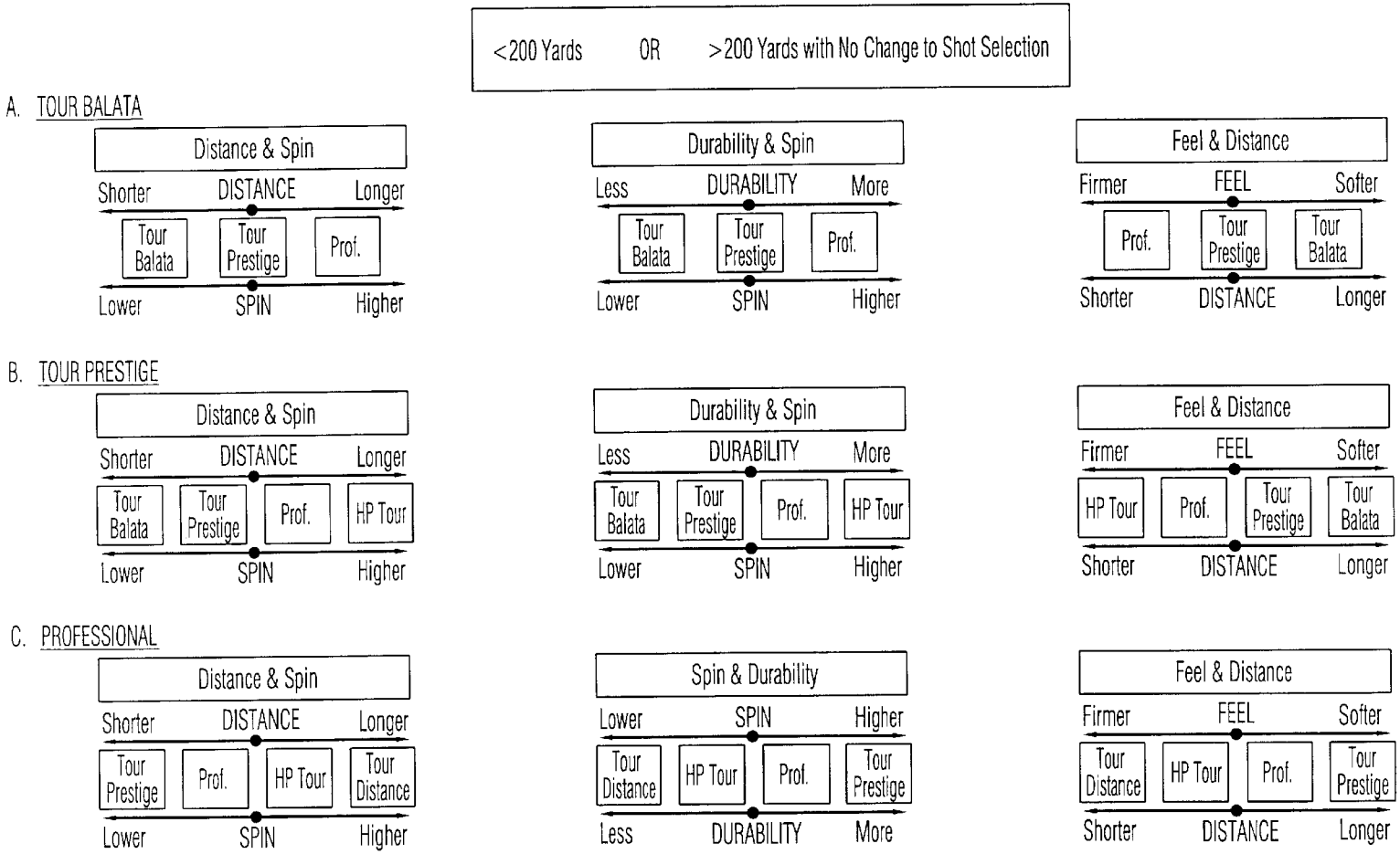
FIG. 8A sets forth a variety of performance relationships for a set of golf balls.
Figure 8B:
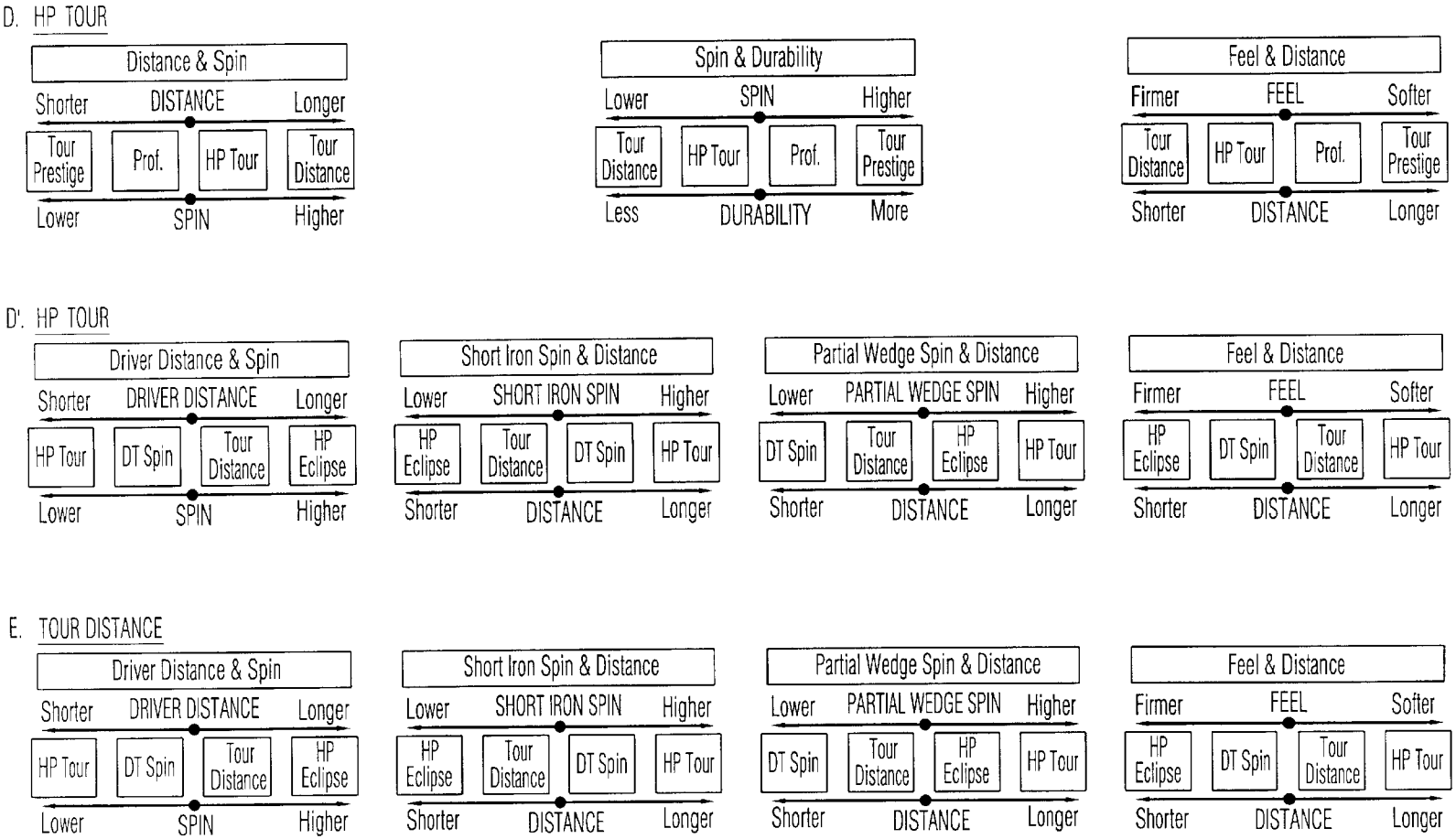
FIG. 8B sets forth a second variety of performance relationships for a set of golf balls.
Figure 8C:
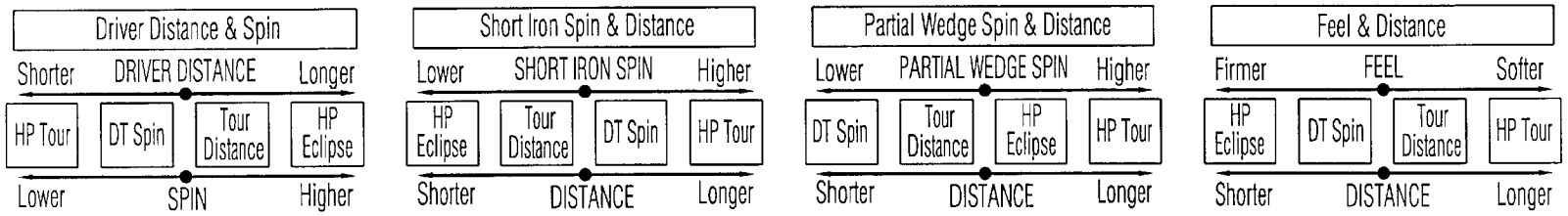
FIG. 8C sets forth a third variety of performance relationships for a set of golf balls.
Figure 8C:
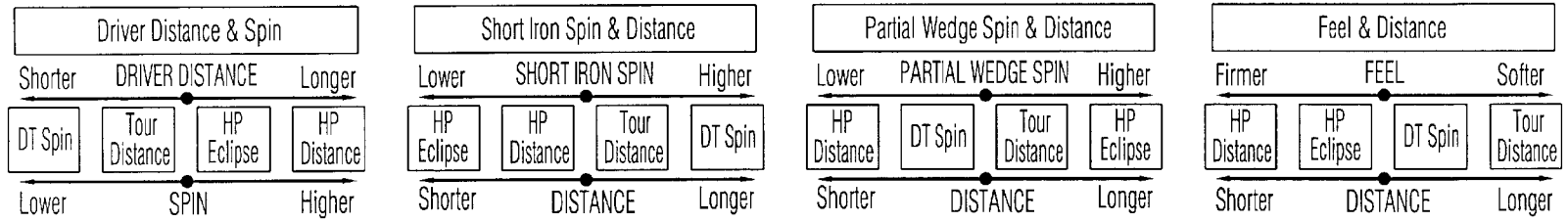
Figure 8D:
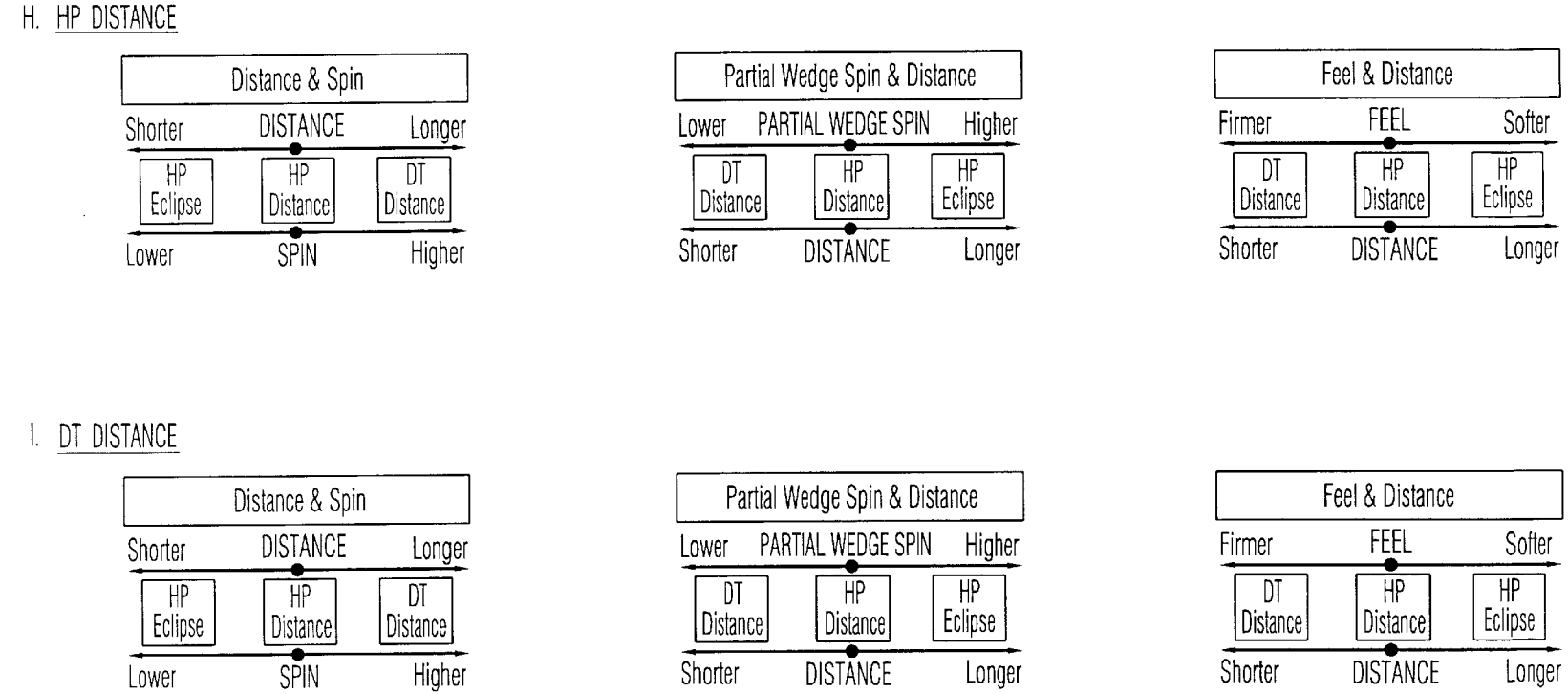
FIG. 8D sets forth a fourth variety of performance relationships for a set of golf balls.

Referring to FIGS. 7–8, in the preferred first step, the golfer is queried, 500, as to whether they have determined a golf ball that is best for their game from a predetermined set of golf balls by determining their critical playing characteristics, prioritizing ball performance characteristics, and selecting a golf ball from the set of golf balls which best matches their critical playing characteristics for the purpose of reducing their score. If the golfer has not determined a preferred golf ball, 502, they are directed to the series of questions to determine their preferred golf ball critical playing characteristics and, subsequently, a golf ball, as defined by the decision trees of FIGS. 1–6 and the method presented above. If the golfer has determined their critical playing characteristics and has a recommended or suggested golf ball that is best for their game, 504, they are preferably asked to respond to at least one question designed to aid the manufacturer in further golf ball manufacture and design by providing "feedback" regarding golfers' likes and dislikes of the recommended golf ball and, preferably, comparison to golf balls from other manufacturers. More preferably, the golfer is asked a plurality of questions, 506. This "feedback" process preferably includes, but is not limited to, at least one question regarding the original golf ball selection and the golfer's opinion on whether or not it was the correct ball for their critical playing characteristics and, if so, will the golfer continue to play the recommended ball. A binary response by the golfer is preferred, such as a yes/no response. The golfer may input or select their preferred responses by a plurality of means such as using a computer input device such as a mouse or a keyboard, a telephone touch pad, by tactile input through a computer monitor, or by voice recognition. Preferably, the golfer's input or selection is accomplished with a computer mouse.

If the golfer responds positively ("yes," for example), 508, to whether or not the original ball recommendation was the correct ball for their critical playing characteristics, the golfer may be asked, for example, to rate at least one ball characteristic and, preferably, a plurality of characteristics, 510, such as driver distance, iron distance, mid-iron spin, short iron spin, partial wedge spin, feel, and durability. In an additional embodiment, the golfer may enter an "open-ended" feedback area for further questioning to provide other information to better aid the manufacturer in future golf ball construction. Preferably, the golfer is asked to compare the recommended golf ball to a previously played golf ball, such as that from another manufacturer, 512.

If the response to the binary response is "no," i.e., that the golfer would not continue to play the originally recommended ball, 514, the golfer is directed, for example, to an interactive area for further refinement of the golfer's critical playing characteristics. In the interactive refinement area, the golfer is preferably asked at least one question about their golf game and/or their playing characteristics. More preferably, the golfer is asked whether they hit their drive greater than a preselected distance. Most preferably, the golfer is asked, 516, whether they hit their drive greater than or less than 200 yards. Again, a binary response by the golfer is preferred, such as a yes/no response. The golfer may also use any input device, such as a keyboard, mouse, touch, or stylus (such as that from a Palm Pilot®-type handheld PC) to select the response.

Referring to FIG. 7, if the golfer responds that their drive is less than 200 yards, 518, for example, the originally recommended golf ball is presented, along with a set of different golf balls, 520, each having different performance characteristics. From this set of golf balls, 520 (A–I), the golfer is then presented with a set of performance relationships from which the golfer may select to change to further refine the original the characteristics of the originally recommended ball. The performance relationships may be any golf ball characteristic relationships, but are preferably those that are oppositely related, i.e., an increase or change in one characteristic is matched by a decrease or opposite change in another related characteristic, simply by their relationship. It is envisioned that the performance characteristics include, but are not limited to, distance and spin, durability and spin, feel and distance, driver distance and spin, short iron spin and distance, and partial wedge spin and distance. In a preferred embodiment, at least one of the golf balls in the set may have different performance relationships based on the golfer's response to the plurality of questions, 506.

For example, if the golfer were to select distance and spin as the performance relationship of the recommended golf ball they would most like to change, the golfer can select the desired spin and distance characteristics on a sliding scale, i.e., the golfer positions a marker on the 'spin' scale, which ranges from low spin to high spin, at the level of spin that said golfer considers ideal. Within a particular subset of golf balls, including the golfer's original selection and at least one other golf ball having different characteristics, distance is related to spin in an opposite manner and is concurrently adjusted on its scale to reflect this property. Any of the other oppositely related performance relationships may be selected in a similar manner. More preferably, the desired golf ball performance characteristic is determined by having the golfer position a marker along a scale bar representing 'spin' at a desired value (normalized to a value of 1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection. In this manner, the golfer can adjust the performance characteristic to a desired point and, in this manner, select a different golf ball that better matches the golfer's game and preferred playing characteristics.

If the golfer indicates that the average driver distance is greater than 200 yards, 522, at least one question is presented to further aid in defining the golfer's critical playing characteristics, 524, and, subsequently, the ideal golf ball performance characteristics. The questions may include, but are not limited to, determining which shot most affects the golfer's score, 526, and whether the golfer would keep (no change), 528, or change, 530, that selection based on their original response. Referring to the decision tree set forth in FIG. 7, a plurality of options presented to the golfer that are critical to their score on a typical golf hole may include, but are not limited to, the drive or tee shot, the second shot or the approach shot, or the third shot, which typically includes the short game and/or chipping and putting around the green. If the golfer selects a change in the critical shot affecting their score, they then, for example, may be directed, 532, to the method set forth above and presented in FIGS. 1–6 to have a different golf ball recommended for their critical playing characteristics. If the golfer agrees with the original selection of their shot most affecting their score, they are directed, 534, to the iterative method for further refining their preferred golf ball, as set forth above and presented in FIGS. 7–8.

In another embodiment of the present invention, determining the golfer's current golf ball, determining whether matching the golf ball meets the golfer's critical playing characteristics, iteratively prioritizing the golfer's golf ball performance characteristics, selecting a second golf ball that best matches the golfer's prioritized critical playing characteristics, and providing a feedback loop for further optimizing the golf ball, is determined using a portable storage device, such as a Palm Pilot®, a laptop PC, a dedicated handheld PC, and a wireless web-compatible cell phone.

The term "about," as used herein in connection with one or more numbers or numerical ranges, should be understood to refer to all such numbers, including all numbers in a range.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed:

1. A method for interactively determining an optimal golf ball for a golfer comprising the steps of:

determining which golf ball is currently used by the golfer and whether the golf ball meets the golfer's critical playing characteristics;

iteratively prioritizing the golfer's golf ball performance characteristics to form prioritized critical playing characteristics;

selecting a second golf ball from a set of golf balls that best matches the golfer's prioritized critical playing characteristics; and further providing a feedback loop for further optimizing the golf ball.

2. The method of claim 1, wherein the step of determining if the golf ball meets the golfer's critical playing characteristics comprises a plurality of questions.

3. The method of claim 1, wherein the step of prioritizing the ball performance characteristics comprises an interactive process of evaluating opposing ball characteristics.

4. The method of claim 3, wherein the opposing ball characteristics comprise at least one of distance, spin, partial wedge spin, short iron spin, driver distance, durability, and feel.

5. The method of claim 4, wherein a ball performance relationship is selected by the golfer expressing a preference of golf ball distance versus golf ball spin.

6. The method of claim 4, wherein the golf ball performance relationship is selected by the golfer expressing a preference of golf ball durability versus golf ball spin.

7. The method of claim 4, wherein the golf ball performance relationship is selected by the golfer expressing a preference of golf ball feel versus golf ball distance.

8. The method of claim 4, wherein the golf ball performance relationship is selected by the golfer expressing a preference of golf ball driver distance versus golf ball spin.

9. The method of claim 4, wherein the golf ball performance relationship is selected by the golfer expressing a preference of golf ball distance versus golf ball short iron spin.

10. The method of claim 4, wherein the golf ball performance relationship is selected by the golfer expressing a preference of golf ball distance versus golf ball partial wedge spin.

11. The method of claim 3, wherein the step of evaluating the opposing ball performance characteristics includes comparing at least one of a first group of characteristics comprising distance, durability, and driver distance versus at least one of a second group of characteristics comprising spin, feel, short iron spin, and partial wedge spin, to determine the ball performance relationships.

12. The method of claim 1, wherein the steps of determining the golfer's current golf ball and whether the golf ball meets the golfer's critical playing characteristic and prioritizing ball performance characteristics is performed by an online interaction.

13. The method of claim 1, wherein the steps of determining the golfer's current golf ball and whether the golf ball meets the golfer's critical playing characteristic and prioritizing ball performance characteristics is performed on a world wide web site.

14. The method of claim 1, wherein the steps of determining the golfer's current golf ball and whether the golf ball meets the golfer's critical playing characteristic and prioritizing ball performance characteristics is performed by using a computer program stored on one or more of a plurality of data storage devices.

15. The method of claim 1, wherein the golfer's recommended golf ball is compared to a previously played golf ball through interactive responses to a plurality of questions.

16. A method for selecting a golf ball from a predetermined set of golf balls comprising the steps of:

determining the golfer's critical playing characteristics;

prioritizing ball performance characteristics;

selecting a golf ball from the set of golf balls which best matches the golfer's critical playing characteristics; and providing a feedback loop for further optimizing the golf ball selection.

17. The method of claim 16, wherein the step of determining the golfer's critical playing characteristics comprises a plurality of questions.

18. The method of claim 16, wherein the step of prioritizing ball performance characteristics comprises an interactive process of evaluating opposing ball characteristics.

19. The method of claim 18, wherein the opposing ball characteristics comprise at least one of distance, spin, partial wedge spin, short iron spin, driver distance, durability, and feel.

20. The method of claim 16, wherein the steps of determining the golfer's critical playing characteristics and prioritizing ball performance characteristics is performed online.

21. The method of claim 16, wherein the selected golf ball is compared to a previously played golf ball through interactive responses to a plurality of questions.

22. A method for interactively determining an optimal golf ball for a golfer comprising the steps of:

determining which golf ball is currently used by the golfer and whether the golf ball meets the golfer's critical playing characteristics;

iteratively prioritizing the golfer's golf ball performance characteristics to form prioritized critical playing characteristics; and selecting a second golf ball from a set of golf balls that best matches the golfer's prioritized critical playing characteristics;

wherein the golfer's recommended golf ball is compared to a previously played golf ball through interactive responses to a plurality of questions.

23. The method of claim 22, wherein the step of determining the golfer's critical playing characteristics comprises a plurality of questions.

24. The method of claim 22, wherein the step of prioritizing ball performance characteristics comprises an interactive process of evaluating opposing ball characteristics.

25. The method of claim 22, wherein the opposing ball characteristics comprise at least one of distance, spin, partial wedge spin, short iron spin, driver distance, durability, and feel.

26. The method of claim 22, wherein the steps of determining the golfer's critical playing characteristics and prioritizing ball performance characteristics is performed online.

* * * * *